US009830886B2

(12) United States Patent
Higashi et al.

(10) Patent No.: US 9,830,886 B2
(45) Date of Patent: Nov. 28, 2017

(54) DISPLAY DEVICE, METHOD OF DRIVING DISPLAY DEVICE, AND ELECTRONIC APPARATUS

(71) Applicant: Japan Display Inc., Tokyo (JP)

(72) Inventors: Amane Higashi, Tokyo (JP); Toshiyuki Nagatsuma, Tokyo (JP); Akira Sakaigawa, Tokyo (JP); Masaaki Kabe, Tokyo (JP)

(73) Assignee: Japan Display Inc., Tokyo (JP)

( * ) Notice: Subject to any disclaimer, the term of this patent is extended or adjusted under 35 U.S.C. 154(b) by 140 days.

(21) Appl. No.: 14/710,110

(22) Filed: May 12, 2015

(65) Prior Publication Data

US 2015/0332643 A1 Nov. 19, 2015

(30) Foreign Application Priority Data

May 15, 2014 (JP) ..... 2014-101754

(51) Int. Cl.
*G09G 5/24* (2006.01)
*G09G 3/36* (2006.01)
*G09G 3/20* (2006.01)

(52) U.S. Cl.
CPC ..... *G09G 5/243* (2013.01); *G09G 3/2066* (2013.01); *G09G 3/2081* (2013.01); *G09G 3/3607* (2013.01); *G09G 3/3648* (2013.01); *G09G 2300/0452* (2013.01); *G09G 2320/04* (2013.01); *G09G 2330/021* (2013.01); *G09G 2340/06* (2013.01); *G09G 2340/145* (2013.01)

(58) Field of Classification Search
CPC .... G09G 5/243; G09G 3/2081; G09G 3/2066; G09G 3/3648; G09G 3/3607; G09G 2300/0452; G09G 2340/145; G09G 2330/021; G09G 2320/04; G09G 2340/06
See application file for complete search history.

(56) References Cited

U.S. PATENT DOCUMENTS

2011/0181633 A1* 7/2011 Higashi ..... G09G 3/2003 345/691
2011/0181635 A1 7/2011 Kabe et al.
2012/0050345 A1* 3/2012 Higashi ..... G09G 3/3426 345/690
2013/0027441 A1* 1/2013 Kabe ..... G09G 3/3413 345/690
2013/0241810 A1 9/2013 Higashi et al.

FOREIGN PATENT DOCUMENTS

JP 2011-154323 8/2011
JP 2013-195605 9/2013

* cited by examiner

*Primary Examiner* — Aneeta Yodichkas
(74) *Attorney, Agent, or Firm* — K&L Gates LLP

(57) ABSTRACT

According to an aspect, a display device includes an image display panel in which pixels each including first to fourth sub-pixels are arranged in a two-dimensional matrix; and a signal processing unit that converts an input signal into an output signal and outputs the generated output signal to the image display panel. The signal processing unit determines an expansion coefficient, obtains a generated signal of the fourth sub-pixel in each pixel based on input signals of the first to the third sub-pixels in the pixel itself and the expansion coefficient, obtains an output signal for the fourth sub-pixel in each pixel based on a generated signal of the fourth sub-pixel in the pixel itself and a generated signal of the fourth sub-pixel in an adjacent pixel to be output to the fourth sub-pixel.

8 Claims, 9 Drawing Sheets

DISPLAY DEVICE, METHOD OF DRIVING DISPLAY DEVICE, AND ELECTRONIC APPARATUS

CROSS REFERENCES TO RELATED APPLICATIONS

The present application claims priority to Japanese Priority Patent Application JP 2014-101754 filed in the Japan Patent Office on May 15, 2014, the entire content of which is hereby incorporated by reference.

BACKGROUND

1. Technical Field

The present disclosure relates to a display device, a method of driving the display device, and an electronic apparatus including the display device.

2. Description of the Related Art

In recent years, demand has been increased for display devices for a mobile apparatus such as a cellular telephone and electronic paper. In such display devices, one pixel includes a plurality of sub-pixels that output light of different colors. Various colors are displayed using one pixel by switching ON/OFF of display of the sub-pixels. Display characteristics such as resolution and luminance have been improved year after year in such display devices. However, an aperture ratio is reduced as the resolution increases, so that luminance of a backlight needs to be increased to achieve high luminance, which leads to increase in power consumption of the backlight. To solve this problem, a technique has been developed for adding a white sub-pixel serving as a fourth sub-pixel to red, green, and blue sub-pixels serving as first to third sub-pixels known in the art (for example, refer to Japanese Patent Application Laid-open Publication No. 2011-154323 (JP-A-2011-154323)). According to this technique, the white sub-pixel enhances the luminance to lower a current value of the backlight and reduce the power consumption.

Japanese Patent Application Laid-open Publication No. 2013-195605 discloses a technique for reducing the luminance of a white sub-pixel to prevent deterioration in an image.

When the luminance of the white sub-pixel is reduced, the following phenomenon may occur. That is, an image may be generated in a state where a pixel having relatively low luminance in which only red, green, and blue sub-pixels are lit whereas the white sub-pixel is not lit or is lit with a small amount of luminance, and a pixel having high luminance in which all of the red, green, blue, and white sub-pixels are lit are adjacent to each other. In this case, a white sub-pixel not being lit or a white sub-pixel being lit with a small amount of luminance is darker than the other sub-pixels, so that the white sub-pixel is visually recognized as a dark streak, dot, or the like, which may deteriorate the image.

For the foregoing reasons, there is a need for a display device, a method of driving a display device, and an electronic apparatus that can prevent deterioration in an image.

SUMMARY

According to an aspect, a display device includes: an image display panel in which pixels each including a first sub-pixel that displays a first color, a second sub-pixel that displays a second color, a third sub-pixel that displays a third color, and a fourth sub-pixel that displays a fourth color with higher luminance than that of the first sub-pixel, the second sub-pixel, and the third sub-pixel are arranged in a two-dimensional matrix; and a signal processing unit that converts an input value of an input signal into an extended value in a color space extended with the first color, the second color, the third color, and the fourth color to generate an output signal and outputs the generated output signal to the image display panel. The signal processing unit determines an expansion coefficient related to the image display panel, obtains a generated signal of the fourth sub-pixel in each pixel based on an input signal of the first sub-pixel in the pixel itself, an input signal of the second sub-pixel in the pixel itself, and an input signal of the third sub-pixel in the pixel itself, and the expansion coefficient, obtains an output signal for the fourth sub-pixel in each pixel based on the generated signal of the fourth sub-pixel in the pixel itself and a generated signal of the fourth sub-pixel in a pixel adjacent thereto to be output to the fourth sub-pixel, obtains an output signal for the first sub-pixel in each pixel based on at least an input signal of the first sub-pixel, the expansion coefficient, and the output signal for the fourth sub-pixel to be output to the first sub-pixel, obtains an output signal for the second sub-pixel in each pixel based on at least the input signal of the second sub-pixel, the expansion coefficient, and the output signal for the fourth sub-pixel to be output to the second sub-pixel, and obtains an output signal for the third sub-pixel in each pixel based on at least the input signal of the third sub-pixel, the expansion coefficient, and the output signal for the fourth sub-pixel to be output to the third sub-pixel.

According to another aspect, an electronic apparatus includes the display device, and a control device that supplies the input signal to the display device.

According to another aspect, a method of driving a display device that includes an image display panel in which pixels each including a first sub-pixel that displays a first color, a second sub-pixel that displays a second color, a third sub-pixel that displays a third color, and a fourth sub-pixel that displays a fourth color with higher luminance than that of the first sub-pixel, the second sub-pixel, and the third sub-pixel are arranged in a two-dimensional matrix, includes obtaining an output signal for each of the first sub-pixel, the second sub-pixel, the third sub-pixel, and the fourth sub-pixel; and controlling an operation of each of the first sub-pixel, the second sub-pixel, the third sub-pixel, and the fourth sub-pixel based on the output signal. The obtaining of the output signal includes: determining an expansion coefficient related to the image display panel, obtaining a generated signal of the fourth sub-pixel in each pixel based on an input signal of the first sub-pixel in the pixel itself, an input signal of the second sub-pixel in the pixel itself, and an input signal of the third sub-pixel in the pixel itself, and the expansion coefficient, obtaining an output signal for the fourth sub-pixel in each pixel based on the generated signal of the fourth sub-pixel in the pixel itself and a generated signal of the fourth sub-pixel in a pixel adjacent thereto to be output to the fourth sub-pixel, obtaining an output signal for the first sub-pixel in each pixel based on at least an input signal of the first sub-pixel, the expansion coefficient, and the output signal for the fourth sub-pixel to be output to the first sub-pixel, obtaining an output signal for the second sub-pixel in each pixel based on at least the input signal of the second sub-pixel, the expansion coefficient, and the output signal for the fourth sub-pixel to be output to the second sub-pixel, and obtaining an output signal for the third sub-pixel in each pixel based on at least the input signal of the third sub-pixel, the expansion coefficient, and the output signal for the fourth sub-pixel to be output to the third sub-pixel.

Additional features and advantages are described herein, and will be apparent from the following Detailed Description and the figures.

DETAILED DESCRIPTION

Figure 1:
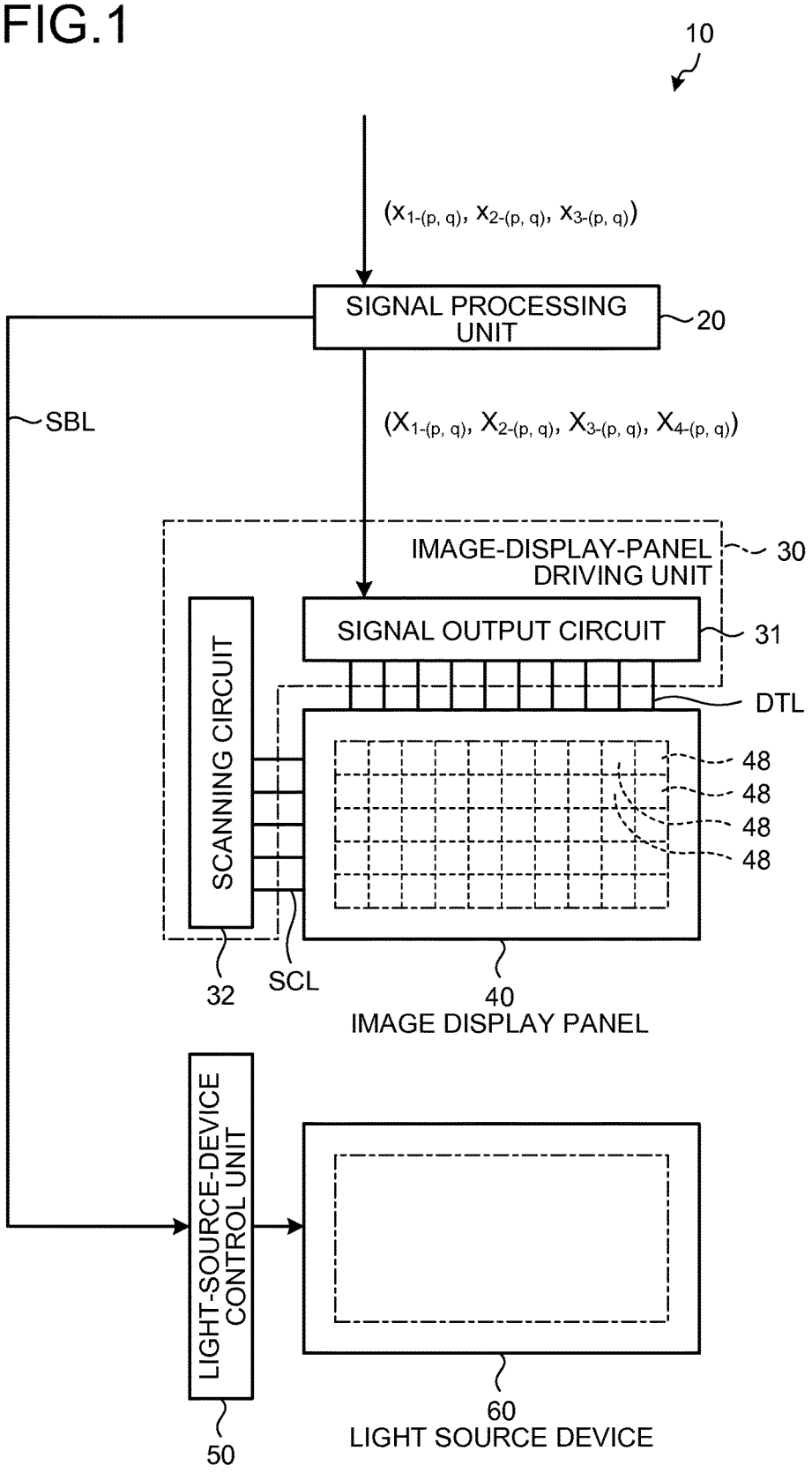
FIG. 1 is a block diagram illustrating an example of a configuration of a display device according to a first embodiment.

The following describes embodiments of the present invention with reference to the drawings. The disclosure is merely an example, and the present invention naturally encompasses an appropriate modification maintaining the gist of the invention that is easily conceivable by those skilled in the art. To further clarify the description, a width, a thickness, a shape, and the like of each component may be schematically illustrated in the drawings as compared with an actual aspect. However, this is merely an example and interpretation of the invention is not limited thereto. The same element as that described in the drawing that has already been discussed is denoted by the same reference numeral through the description and the drawings, and detailed description thereof will not be repeated in some cases.

1. First Embodiment

Configuration of Display Device

FIG. 1 is a block diagram illustrating an example of a configuration of a display device according to a first embodiment. As illustrated in FIG. 1, a display device 10 according to the first embodiment includes a signal processing unit 20, an image-display-panel driving unit 30, an image display panel 40, a light-source-device control unit 50, and a light source device 60. In the display device 10, the signal processing unit 20 transmits a signal to each component of the display device 10, the image-display-panel driving unit 30 controls driving of the image display panel 40 based on the signal from the signal processing unit 20, the image display panel 40 causes an image to be displayed based on the signal from the image-display-panel driving unit 30, the light-source-device control unit 50 controls driving of the light source device 60 based on the signal from the signal processing unit 20, and the light source device 60 illuminates the image display panel 40 from a back surface thereof based on the signal of the light-source-device control unit 50. Thus, the display device 10 displays the image. The display device 10 has a configuration similar to that of an image display device assembly disclosed in JP-A-2011-154323, and various modifications disclosed in JP-A-2011-154323 can be applied to the display device 10.

Figure 2:
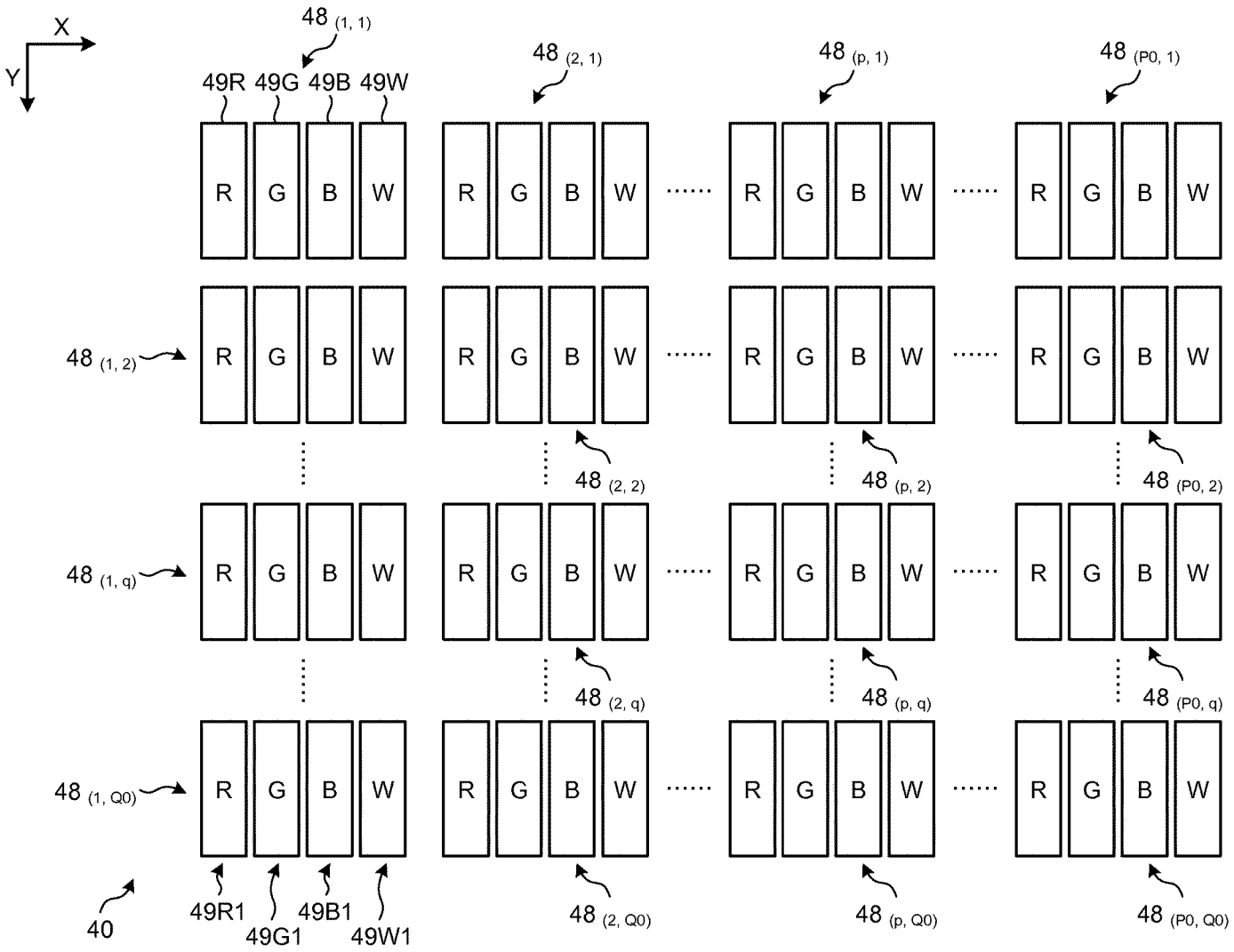
FIG. 2 is a diagram illustrating a pixel array of an image display panel according to the first embodiment.
Figure 3:
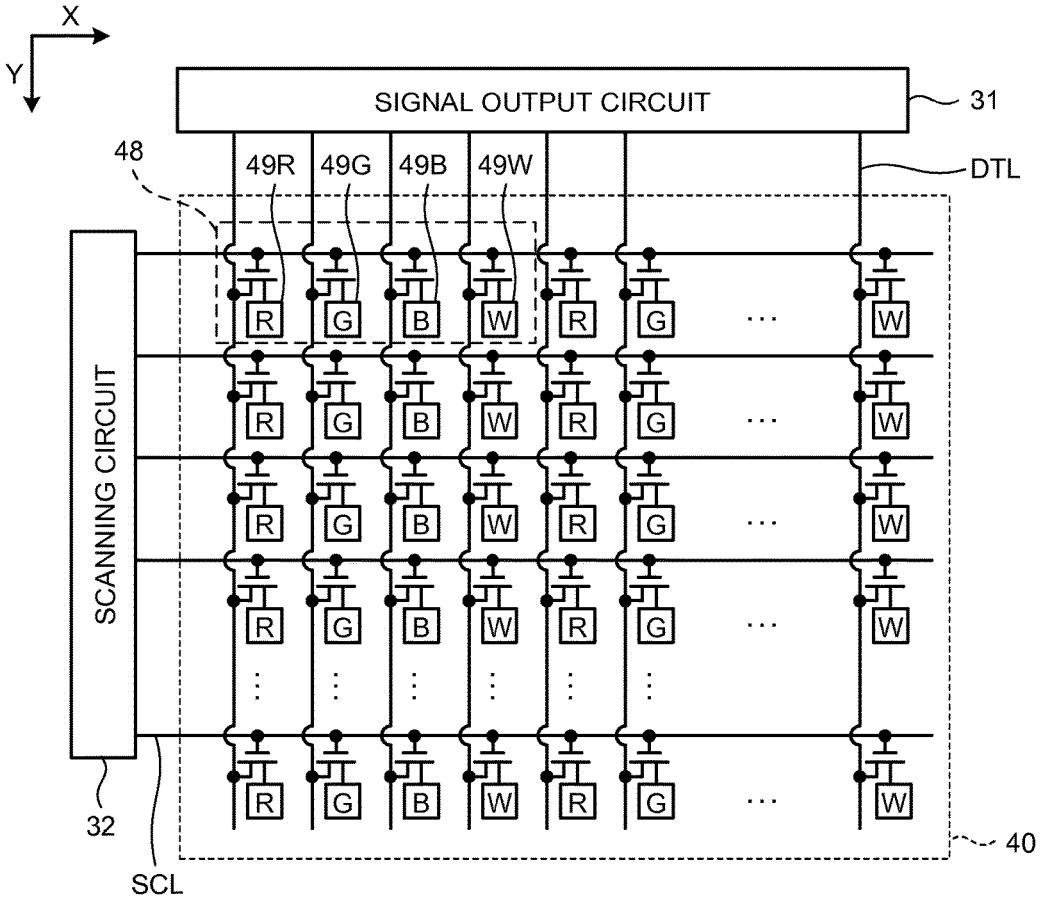
FIG. 3 is a conceptual diagram of the image display panel and an image-display-panel driving unit according to the first embodiment.

FIG. 2 is a diagram illustrating a pixel array of the image display panel according to the first embodiment. FIG. 3 is a conceptual diagram of the image display panel and the image-display-panel driving unit according to the first embodiment. As illustrated in FIGS. 2 and 3, pixels 48 are arranged in a two-dimensional matrix of P0×Q0 (P0 in a row direction, and Q0 in a column direction) in the image display panel 40. FIGS. 2 and 3 illustrate an example in which the pixels 48 are arranged in a matrix on an XY two-dimensional coordinate system. In this example, the row direction as the first direction is the X-axial direction, and the column direction as the second direction is the Y-axial direction. Alternatively, the row direction may be the Y-axial direction, and the column direction may be the X-axial direction. Hereinafter, to identify a position at which the pixel 48 is arranged, the pixel 48 arranged at a p-th position in the X-axial direction from the left of FIG. 2 and a q-th position in the Y-axial direction from the top of FIG. 2 is represented as a pixel $\mathbf{48}_{(p,\ q)}$ (where $1 \leq p \leq P0$, and $1 \leq q \leq Q0$).

Each of the pixels 48 includes a first sub-pixel 49R, a second sub-pixel 49G, a third sub-pixel 49B, and a fourth sub-pixel 49W. The first sub-pixel 49R displays a first primary color (for example, red). The second sub-pixel 49G displays a second primary color (for example, green). The third sub-pixel 49B displays a third primary color (for example, blue). The fourth sub-pixel 49W displays a fourth color (in the first embodiment, white). In this way, each of the pixels 48 arranged in a matrix in the image display panel 40 includes the first sub-pixel 49R that displays a first color, the second sub-pixel 49G that displays a second color, the third sub-pixel 49B that displays a third color, and the fourth sub-pixel 49W that displays a fourth color. The first color, the second color, the third color, and the fourth color are not limited to the first primary color, the second primary color, the third primary color, and white. It is adequate as long as the colors are different from each other, such as complementary colors. When the fourth sub-pixel 49W that displays the fourth color preferably has higher luminance than that of the first sub-pixel 49R that displays the first color, the second sub-pixel 49G that displays the second color, and the third sub-pixel 49B that displays the third color when irradiated with the same lighting quantity of a light source. The fourth sub-pixel 49W displays the fourth color with higher luminance than that displayed by the first sub-pixel 49R, the second sub-pixel 49G, and the third sub-pixel 49B when irradiated with the same lighting quantity of the light source. In the following description, the first sub-pixel 49R, the second sub-pixel 49G, the third sub-pixel 49B, and the fourth sub-pixel 49W may be collectively referred to as a sub-pixel 49 when they are not required to be distinguished from each other. To identify the position at which the sub-pixel is arranged, for example, the fourth sub-pixel of the pixel $\mathbf{48}_{(p,\ q)}$ is referred to as a fourth sub-pixel $\mathbf{49}W_{(p,\ q)}$.

As illustrated in FIG. 2, in the pixel 48, the first sub-pixel 49R, the second sub-pixel 49G, the third sub-pixel 49B, and the fourth sub-pixel 49W are arranged in this order from the left to the right in the X-axial direction of FIG. 2. That is, the fourth sub-pixel 49W is arranged at an end in the X-axial direction of the pixel 48. In the image display panel 40, the first sub-pixels 49R, the second sub-pixels 49G, the third sub-pixels 49B, and the fourth sub-pixels 49W are linearly arranged as a first sub-pixel column 49R1, a second sub-pixel column 49G1, a third sub-pixel column 49B1, and a fourth sub-pixel column 49W1, respectively, along the Y-axial direction. In the image display panel 40, the first sub-pixel column 49R1, the second sub-pixel column 49G1, the third sub-pixel column 49B1, and the fourth sub-pixel column 49W1 are periodically arranged in this order from the left to the right in FIG. 2 along the X-axial direction.

More specifically, the display device 10 is a transmissive color liquid crystal display device. The image display panel 40 is a color liquid crystal display panel in which a first color filter that allows the first primary color to pass through is arranged between the first sub-pixel 49R and an image observer, a second color filter that allows the second primary color to pass through is arranged between the second sub-pixel 49G and the image observer, and a third color filter that allows the third primary color to pass through is arranged between the third sub-pixel 49B and the image observer. In the image display panel 40, there is no color filter between the fourth sub-pixel 49W and the image observer. A transparent resin layer may be provided for the fourth sub-pixel 49W instead of the color filter. Alternatively, a fourth color filter may be provided for the fourth sub-pixel 49W. In this way, by arranging the transparent resin layer, the image display panel 40 can suppress the occurrence of a large gap above the fourth sub-pixel 49W, otherwise a large gap occurs because no color filter is arranged for the fourth sub-pixel 49W.

As illustrated in FIG. 1, the signal processing unit 20 is an arithmetic processing circuit that controls operations of the image display panel 40 and the light source device 60 via the image-display-panel driving unit 30 and the light-source-device control unit 50. The signal processing unit 20 is coupled to the image-display-panel driving unit 30 and the light-source-device control unit 50.

The signal processing unit 20 processes an input signal input from an external application processor (a host CPU, not illustrated) to generate an output signal and a light-source-device control signal SBL. The signal processing unit 20 converts an input value of the input signal into an extended value (output signal) in the extended color space (in the first embodiment, an HSV color space) extended with the first color, the second color, the third color, and the fourth color to generate an output signal. The signal processing unit 20 then outputs the generated output signal to the image-display-panel driving unit 30. The signal processing unit 20 outputs the light-source-device control signal SBL to the light-source-device control unit 50. In the first embodiment, the extended color space is the HSV (Hue-Saturation-Value, Value is also called Brightness.) color space. However, the extended color space is not limited thereto, and may be an XYZ color space, a YUV space, and other coordinate systems.

Figure 4:
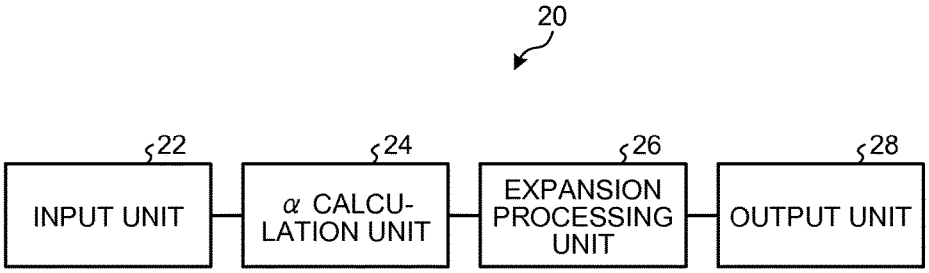
FIG. 4 is a schematic diagram illustrating an overview of a configuration of a signal processing unit according to the first embodiment.

FIG. 4 is a schematic diagram illustrating an overview of a configuration of the signal processing unit according to the first embodiment. As illustrated in FIG. 4, the signal processing unit 20 includes an input unit 22, an α calculation unit 24, an expansion processing unit 26, and an output unit 28.

The input unit 22 receives the input signal from the external application processor. The α calculation unit 24 calculates an expansion coefficient α based on the input signal input to the input unit 22. Calculation processing of the expansion coefficient α will be described later. The expansion processing unit 26 performs expansion processing on the input signal using the expansion coefficient α calculated by the α calculation unit 24 and the input signal input to the input unit 22. That is, the expansion processing unit 26 converts the input value of the input signal into the extended value in the extended color space (HSV color space in the first embodiment) to generate the output signal. The expansion processing will be described later. The output unit 28 outputs the output signal generated by the expansion processing unit 26 to the image-display-panel driving unit 30.

As illustrated in the FIG. 1 and FIG. 3, the image-display-panel driving unit 30 includes a signal output circuit 31 and a scanning circuit 32. In the image-display-panel driving unit 30, the signal output circuit 31 holds video signals to be sequentially output to the image display panel 40. More specifically, the signal output circuit 31 outputs an image output signal having a predetermined electric potential corresponding to the output signal from the signal processing unit 20 to the image display panel 40. The signal output circuit 31 is electrically coupled to the image display panel 40 via a signal line DTL. The scanning circuit 32 controls ON/OFF of a switching element (for example, a TFT) for controlling an operation of the sub-pixel 49 (light transmittance) in the image display panel 40. The scanning circuit 32 is electrically coupled to the image display panel 40 via wiring SCL.

The light source device 60 is arranged on a back surface side of the image display panel 40, and illuminates the image display panel 40 by emitting light thereto. The light source device 60 irradiates the image display panel 40 with light and makes the image display panel 40 brighter.

The light-source-device control unit 50 controls the amount and/or the other properties of the light output from the light source device 60. Specifically, the light-source-device control unit 50 adjusts a voltage and the like to be supplied to the light source device 60 based on the light-source-device control signal SBL output from the signal processing unit 20 using pulse width modulation (PWM) and the like, thereby controlling the amount of light (light intensity) that irradiates the image display panel 40.

Operation Performed by Signal Processing Unit

Figure 5:
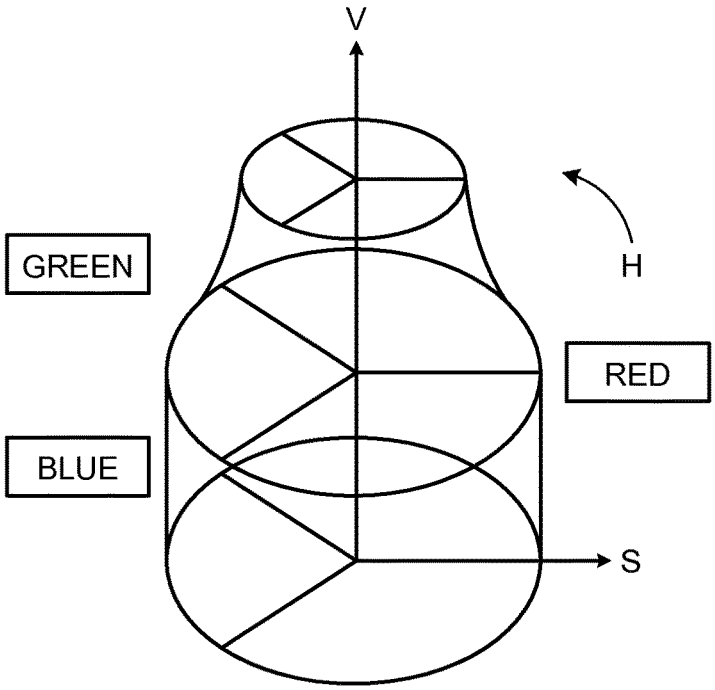
FIG. 5 is a conceptual diagram of an extended color space that can be reproduced by the display device according to the first embodiment.
Figure 6:
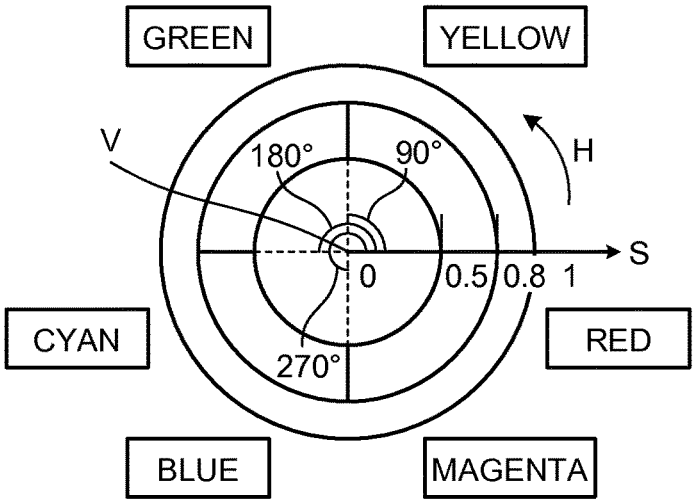
FIG. 6 is a conceptual diagram illustrating a relation between a hue and saturation in the extended color space.

Next, with reference to FIGS. 5 and 6, the following describes an operation performed by the signal processing unit 20. FIG. 5 is a conceptual diagram of the extended color space that can be reproduced by the display device according to the first embodiment. FIG. 6 is a conceptual diagram illustrating a relation between a hue and saturation in the extended color space.

The signal processing unit 20 receives the input signal, which is information of the image to be displayed, input from the external application processor. The input signal includes the information of the image (color) to be displayed at its position for each pixel as the input signal. Specifically, with respect to the (p, q)-th pixel $\mathbf{48}_{(p,\ q)}$ (where $1 \le p \le P_0$, $1 \le q \le Q_0$), the signal processing unit 20 receives a signal input thereto including an input signal of the first sub-pixel 49$R_{(p, q)}$ the signal value of which is $x_{1-(p, q)}$, an input signal of the second sub-pixel 49$G_{(p, q)}$ the signal value of which is $x_{2-(p, q)}$, and an input signal of the third sub-pixel 49$B_{(p, q)}$ the signal value of which is $x_{3-(p, q)}$.

The signal processing unit 20 processes the input signal to generate an output signal for the first sub-pixel for determining the display gradation of the first sub-pixel 49$R_{(p, q)}$ (signal value $X_{1-(p, q)}$), an output signal for the second sub-pixel for determining the display gradation of the second sub-pixel 49$G_{(p, q)}$ (signal value $X_{2-(p, q)}$), an output signal for the third sub-pixel for determining the display gradation of the third sub-pixel 49$B_{(p, q)}$ (signal value $X_{3-(p, q)}$), and an output signal for the fourth sub-pixel for determining the display gradation of the fourth sub-pixel 49$W_{(p, q)}$ (signal value $X_{4-(p, q)}$) to be output as output signals to the image-display-panel driving unit 30.

In the display device 10, the pixel 48 includes the fourth sub-pixel 49W for outputting the fourth color (white) to widen a dynamic range of brightness in the extended color space (in the first embodiment, the HSV color space) as illustrated in FIG. 5. That is, as illustrated in FIG. 5, a substantially trapezoidal three-dimensional shape, in which the maximum value of brightness is reduced as the saturation increases and oblique sides of a cross-sectional shape including a saturation axis and a brightness axis are curved lines, is placed on a cylindrical color space that can be displayed by the first sub-pixel, the second sub-pixel, and the third sub-pixel. The signal processing unit 20 stores the maximum value Vmax(S) of the brightness using the saturation S as a variable in the extended color space (in the first embodiment, the HSV color space) expanded by adding the fourth color (white). That is, the signal processing unit 20 stores the maximum value Vmax(S) of the brightness for respective coordinates (values) of the saturation and the hue regarding the three-dimensional shape of the color space (in the first embodiment, the HSV color space) illustrated in FIG. 5. The input signals include the input signals of the first sub-pixel 49R, the second sub-pixel 49G, and the third sub-pixel 49B, so that the color space of the input signals has a cylindrical shape, that is, the same shape as a cylindrical part of the extended color space (in the first embodiment, the HSV color space).

In the signal processing unit 20, the expansion processing unit 26 calculates the output signal (signal value $X_{1-(p, q)}$) for the first sub-pixel based on at least the input signal (signal value $x_{1-(p, q)}$) of the first sub-pixel and the expansion coefficient α, calculates the output signal (signal value $X_{2-(p, q)}$) for the second sub-pixel based on at least the input signal (signal value $x_{2-(p, q)}$) of the second sub-pixel and the expansion coefficient α, and calculates the output signal (signal value $X_{3-(p, q)}$) for the third sub-pixel based on at least the input signal (signal value $x_{3-(p, q)}$) of the third sub-pixel and the expansion coefficient α.

Specifically, the output signal for the first sub-pixel is calculated based on the input signal of the first sub-pixel, the expansion coefficient α, and the output signal for the fourth sub-pixel, the output signal for the second sub-pixel is calculated based on the input signal of the second sub-pixel, the expansion coefficient α, and the output signal for the fourth sub-pixel, and the output signal for the third sub-pixel is calculated based on the input signal of the third sub-pixel, the expansion coefficient α, and the output signal for the fourth sub-pixel.

That is, where χ is a constant depending on the display device 10, the signal processing unit 20 obtains, from the following expressions (1), (2), and (3), the output signal value $X_{1-(p, q)}$ for the first sub-pixel, the output signal value $X_{2-(p, q)}$ for the second sub-pixel, and the output signal value $X_{3-(p, q)}$ for the third sub-pixel, each of those signal values being output to the (p, q)-th pixel 48$_{(p, q)}$ (or a group of the first sub-pixel 49R, the second sub-pixel 49G, and the third sub-pixel 49B).

$$X_{1-(p,q)}=\alpha\cdot x_{1-(p,q)}-\chi X_{4-(p,q)} \tag{1}$$

$$X_{2-(p,q)}=\alpha\cdot x_{2-(p,q)}-\chi X_{4-(p,q)} \tag{2}$$

$$X_{3-(p,q)}=\alpha\cdot x_{3-(p,q)}-\chi X_{4-(p,q)} \tag{3}$$

The signal processing unit 20 obtains the maximum value Vmax(S) of the brightness using the saturation S as a variable in the color space (for example, the HSV color space) expanded by adding the fourth color, and obtains the saturation S and the brightness V(S) in the pixels 48 based on the input signal values of the sub-pixels 49 in the pixels 48. In the signal processing unit 20, the α calculation unit 24 calculates the expansion coefficient α based on the maximum value Vmax(S) of the brightness and the brightness V(S).

The signal processing unit 20 may determine the expansion coefficient cc so that a proportion of the number of pixels in which a value of the expanded brightness obtained by multiplying the brightness V(S) by the expansion coefficient α exceeds the maximum value Vmax(S) to all the pixels is equal to or smaller than a limit value β. That is, the signal processing unit 20 determines the expansion coefficient α in a range in which a value exceeding the maximum value of the brightness among the values of the expanded brightness does not exceed the value obtained by multiplying the maximum value Vmax(S) by the limit value β. The limit value β is an upper limit value (proportion) of a range of a combination of values of hue and saturation exceeding the maximum value of the brightness of the extended HSV color space.

The saturation S and the brightness V(S) are expressed as follows: S=(Max−Min)/Max, and V(S)=Max. The saturation S takes values of 0 to 1, the brightness V(S) takes values of 0 to $(2^n-1)$, and n is a display gradation bit number. Max is the maximum value among the input signal values of three sub-pixels, that is, the input signal value of the first sub-pixel 49R, the input signal value of the second sub-pixel 49G, and the input signal value of the third sub-pixel 49B, each of those signal values being input to the pixel 48. Min is the minimum value among the input signal values of three sub-pixels, that is, the input signal value of the first sub-pixel 49R, the input signal value of the second sub-pixel 49G, and the input signal value of the third sub-pixel 49B, each of those signal values being input to the pixel 48. A hue H is represented in a range of 0° to 360° as illustrated in FIG. 6. Arranged are red, yellow, green, cyan, blue, magenta, and red from 0° to 360°. In the first embodiment, a region including an angle 0° is red, a region including an angle 120° is green, and a region including an angle 240° is blue.

Generally, with regard to the (p, q)-th pixel, the saturation $S_{(p, q)}$ and the brightness $V(S)_{(p, q)}$ in the cylindrical color space can be obtained from the following expressions (4) and (5) based on the input signal (signal value $x_{1-(p, q)}$) of the first sub-pixel 49$R_{(p, q)}$, the input signal (signal value $x_{2-(p, q)}$) of the second sub-pixel 49$G_{(p, q)}$, and the input signal (signal value $x_{3-(p, q)}$) of the third sub-pixel 49$B_{(p, q)}$.

$$S_{(p,q)}=(\mathrm{Max}_{(p,q)}-\mathrm{Min}_{(p,q)})/\mathrm{Max}_{(p,q)} \tag{4}$$

$$V(S)_{(p,q)}=\mathrm{Max}_{(p,q)} \tag{5}$$

In these expressions, $Max_{(p, q)}$ is the maximum value among the input signal values of three sub-pixels 49, that is, ($x_{1-(p, q)}$, $x_{2-(p, q)}$, and $x_{3-(p, q)}$), and $Min_{(p, q)}$ is the minimum value of the input signal values of three sub-pixels 49, that is, ($x_{1-(p, q)}$, $x_{2-(p, q)}$, and $x_{3-(p, q)}$). In the first embodiment, n is 8. That is, the display gradation bit number is 8 bits (a value of the display gradation is 256 gradations, that is, 0 to 255).

No color filter is arranged for the fourth sub-pixel 49W that displays white. The fourth sub-pixel 49W that displays the fourth color is brighter than the first sub-pixel 49R that displays the first color, the second sub-pixel 49G that displays the second color, and the third sub-pixel 49B that displays the third color when irradiated with the same lighting quantity of a light source. When a signal having a value corresponding to the maximum signal value of the output signal for the first sub-pixel 49R is input to the first sub-pixel 49R, a signal having a value corresponding to the maximum signal value of the output signal for the second sub-pixel 49G is input to the second sub-pixel 49G, and a signal having a value corresponding to the maximum signal value of the output signal for the third sub-pixel 49B is input to the third sub-pixel 49B, luminance of an aggregate of the first sub-pixel 49R, the second sub-pixel 49G, and the third sub-pixel 49B included in the pixel 48 or a group of pixels 48 is $BN_{1-3}$. When a signal having a value corresponding to the maximum signal value of the output signal for the fourth sub-pixel 49W is input to the fourth sub-pixel 49W included in the pixel 48 or a group of pixels 48, the luminance of the fourth sub-pixel 49W is $BN_4$. That is, white (maximum luminance) is displayed by the aggregate of the first sub-pixel 49R, the second sub-pixel 49G, and the third sub-pixel 49B, and the luminance of the white is represented by $BN_{1-3}$. Where $\chi$ is a constant depending on the display device 10, the constant $\chi$ is represented by $\chi=BN_4/BN_{1-3}$.

Specifically, the luminance $BN_4$ when the input signal having a value of display gradation 255 is assumed to be input to the fourth sub-pixel 49W is, for example, 1.5 times the luminance $BN_{1-3}$ of white where the input signals having values of display gradation such as the signal value $x_{1-(p, q)}=255$, the signal value $x_{2-(p, q)}=255$, and the signal value $x_{3-(p, q)}=255$, are input to the aggregate of the first sub-pixel 49R, the second sub-pixel 49G, and the third sub-pixel 49B. That is, in the first embodiment, $\chi=1.5$.

Vmax(S) can be represented by the following expressions (6) and (7).

When $S \leq S_0$:

$$Vmax(S)=(\chi+1)\cdot(2^n-1) \quad (6)$$

When $S_0<S\leq 1$:

$$Vmax(S)=(2^n-1)\cdot(1/S) \quad (7)$$

In these expressions, $S_0=1/(\chi+1)$ is satisfied.

The thus obtained maximum value Vmax(S) of the brightness using the saturation S as a variable in the extended color space (in the first embodiment, the HSV color space) expanded by adding the fourth color is stored in the signal processing unit 20 as a kind of look-up table, for example. Alternatively, the signal processing unit 20 obtains the maximum value Vmax(S) of the brightness using the saturation S as a variable in the expanded color space (in the first embodiment, the HSV color space) as occasion demands.

The signal processing unit 20 obtains an output signal value $X_{4-(p, q)}$ for the fourth sub-pixel 49$W_{(p, q)}$ in the (p, q)-th pixel 48$_{(p, q)}$ by the expansion processing unit 26 as follows. Specifically, the signal processing unit 20 obtains a first generated signal value W1$_{(p, q)}$, a second generated signal value W2$_{(p, q)}$, and a third generated signal value W3$_{(p, q)}$ as generated signal values of the fourth sub-pixel 49$W_{(p, q)}$. The signal processing unit 20 performs averaging processing on the second generated signal value W2$_{(p, q)}$ to calculate a corrected second generated signal value W2AV$_{(p, q)}$. The signal processing unit 20 then performs averaging processing on the third generated signal value W3$_{(p, q)}$ to calculate a corrected third generated signal value W3AV$_{(p, q)}$. Based on these calculations, the signal processing unit 20 obtains the output signal value $X_{4-(p, q)}$ for the fourth sub-pixel 49$W_{(p, q)}$. First, the following describes the calculations of the first generated signal value W1$_{(p, q)}$, the second generated signal value W2$_{(p, q)}$, and the third generated signal value W3$_{(p, q)}$.

Figure 7:
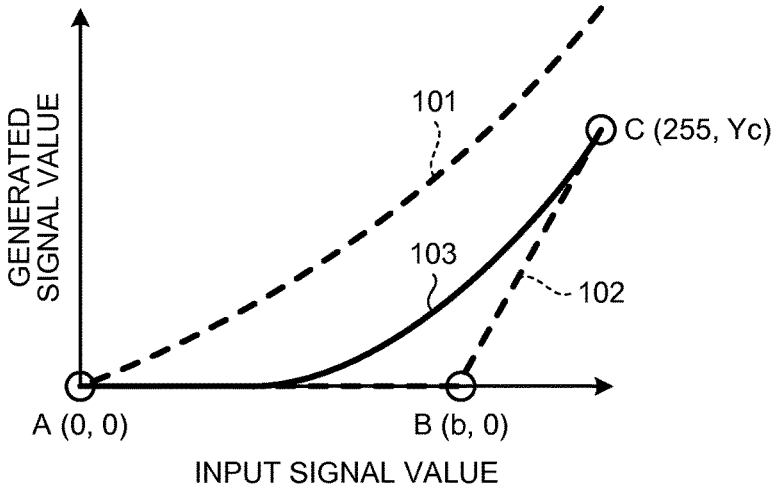
FIG. 7 is a graph representing a generated signal value of a fourth sub-pixel corresponding to an input value.

FIG. 7 is a graph representing a generated signal value of the fourth sub-pixel corresponding to the input value. The horizontal axis in FIG. 7 indicates an input signal value corresponding to a white component. The vertical axis in FIG. 7 indicates the generated signal value of the fourth sub-pixel. A line segment 101 in FIG. 7 indicates the first generated signal value W1$_{(p, q)}$ of the fourth sub-pixel 49$W_{(p, q)}$ depending on the input signal value corresponding to the white component. A line segment 102 in FIG. 7 indicates the second generated signal value W2$_{(p, q)}$ of the fourth sub-pixel 49$W_{(p, q)}$ depending on the input signal value corresponding to the white component. A line segment 103 in FIG. 7 indicates the third generated signal value W3$_{(p, q)}$ of the fourth sub-pixel 49$W_{(p, q)}$ depending on the input signal value corresponding to the white component.

The signal processing unit 20 obtains the first generated signal value W1$_{(p, q)}$ using an expression (8) as follows.

$$W1_{(p,q)}=Min_{(p,q)}\cdot(\alpha/\chi) \quad (8)$$

As represented by the expression (8), the first generated signal value W1$_{(p, q)}$ is a calculation value for replacing the input signals of the first to the third sub-pixels with the output signal for the fourth sub-pixel 49W as much as possible.

The signal processing unit 20 obtains the second generated signal value W2$_{(p, q)}$ through the following expressions (9) to (14).

$$W2A_{(p,q)}=\alpha\cdot x_{1-(p,q)}-(2^n-1) \quad (9)$$

$$W2B_{(p,q)}=\alpha\cdot x_{2-(p,q)}-(2^n-1) \quad (10)$$

$$W2C_{(p,q)}=\alpha\cdot x_{3-(p,q)}-(2^n-1) \quad (11)$$

$$W2D_{(p,q)}=\max(W2A_{(p,q)}, W2B_{(p,q)}, W2C_{(p,q)}) \quad (12)$$

$$W2E_{(p,q)}=Min_{(p,q)}\cdot\alpha \quad (13)$$

$$W2_{(p,q)}=\min(W2D_{(p,q)}, W2E_{(p,q)})/\chi \quad (14)$$

When each value of W2A$_{(p, q)}$, W2B$_{(p, q)}$, W2C$_{(p, q)}$, and W2D$_{(p, q)}$ is negative, 0 (zero) is substituted for the negative value in calculating W2D$_{(p, q)}$ and W2$_{(p, q)}$. The signal processing unit 20 calculates, through the expressions (9) to (11), W2A$_{(p, q)}$, W2B$_{(p, q)}$, and W2C$_{(p, q)}$ that are values obtained by subtracting $(2^n-1)$, that is, possible maximum output values of the first to the third sub-pixels from the input signal values of the first to the third sub-pixels expanded with the expansion coefficient $\alpha$. The signal processing unit 20 then obtains a smaller value between the maximum value among W2A$_{(p, q)}$, W2B$_{(p, q)}$, and W2C$_{(p, q)}$, and W2E$_{(p, q)}$ calculated by the expression (13) as the second generated signal value W2$_{(p, q)}$. The second generated signal value W2$_{(p, q)}$ is a calculation value for replacing the expanded input signals of the first to the third sub-pixels with the output signals for the first to the third sub-pixels as maximum as possible to minimize the replacement of the output signals for the first to the third sub-pixels 49R, 49G, and 49B with the output signal for the fourth sub-pixel 49W.

The signal processing unit 20 generates the line segment 103 in FIG. 7 as follows to obtain the third generated signal value $W3_{(p,\ q)}$. That is, the signal processing unit 20 takes three control points as A(Ax, Ay), B(Bx, By), and C(Cx, Cy). Then B(Basis)—spline curve interpolation expression in this case is defined by the following expressions (15), (16), and (17).

$$X=(1-t)^{2xAx}+2t(1-t)\times Bx+t^{2xCx} \tag{15}$$

$$Y=(1-t)^{2xAy}+2t(1-t)\times By+t^{2xCy} \tag{16}$$

$$t=\lambda/(2^n-1) \tag{17}$$

The expression (15) represents an X-coordinate value (the horizontal axis in FIG. 7), and the expression (16) represents a Y-coordinate value (the vertical axis in FIG. 7). In the expression (17), λ represents an input signal value corresponding to the white component. In this case, n=8, so that the result of the expression (17) is t=λ/255. A value of λ may be a discrete value from 0 to 255, so that 0≤t≤1.

The control points based on $W2_{(p,\ q)}$ (the line segment 102 in FIG. 7) are assumed to be a point A, a point B, and a point C as illustrated in FIG. 7. Coordinate values thereof are assumed to be A(Ax, Ay)=(0, 0), B(Bx, By)=(b, 0), and C(Cx, Cy)=(255, Yc), respectively. As illustrated in FIG. 7, b represents the input signal value corresponding to the white component when the second generated signal value $W2_{(p,\ q)}$ starts to rise from 0. Yc represents a value equal to or smaller than the maximum value of white luminance generated by the fourth sub-pixel. The control point is determined from an empirical value or an actual measured value.

When A(0, 0), B(b, 0), and C(255, Yc) described above are substituted in the expressions (15) and (16), the following expressions (18) and (19) are obtained.

$$X=1+2t(1-t)\times b+t^{510}=2bt(1-t)+1+t^{510} \tag{18}$$

$$Y=1+0+t^{2xYc}=1+t^{2xYc} \tag{19}$$

The line segment 103 in FIG. 7 is defined through the expressions (18) and (19) (a function of X and Y can be obtained when the variable t is eliminated from the two expressions, and the function is represented by the line segment 103). In this way, the third generated signal value $W3_{(p,\ q)}$ can be calculated through B—spline curve interpolation expression defined by the expressions (15), (16), and (17). The third generated signal value $W3_{(p,\ q)}$ is a calculation value, based on the second generated signal value $W2_{(p,\ q)}$, for smoothing a color change in the white component generated by the first to the third sub-pixels and the white component generated by the fourth sub-pixel 49W.

In this way, the signal processing unit 20 calculates the first generated signal value $W1_{(p,\ q)}$, the second generated signal value $W2_{(p,\ q)}$, and the third generated signal value $W3_{(p,\ q)}$. Subsequently, the following describes calculations of the corrected second generated signal value $W2AV_{(p,\ q)}$ and the corrected third generated signal value $W3AV_{(p,\ q)}$.

The signal processing unit 20 averages the second generated signal value $W2_{(p,\ q)}$ of the fourth sub-pixel $49W_{(p,\ q)}$ in the pixel $48_{(p,\ q)}$ and a second generated signal value $W2_{(p+1,\ q)}$ of a fourth sub-pixel $49W_{(p+1,\ q)}$ in an adjacent pixel $48_{(p+1,\ q)}$ to calculate the corrected second generated signal value $W2AV_{(p,\ q)}$ of the fourth sub-pixel $49W_{(p,\ q)}$ in the pixel $48_{(p,\ q)}$. More specifically, the signal processing unit 20 calculates the corrected second generated signal value $W2AV_{(p,\ q)}$ of the fourth sub-pixel $49W_{(p,\ q)}$ through the following expression (20). In the expression (20), d and e are predetermined coefficients.

$$W2AV_{(p,q)}=(d\cdot W2_{(p,q)}+e\cdot W2_{(p+1,q)})/(d+e) \tag{20}$$

The signal processing unit 20 uses the pixel $48_{(p+1,\ q)}$ adjacent to a side on which the fourth sub-pixel $49W_{(p,\ q)}$ is positioned in the X-axial direction as a pixel adjacent to the pixel $48_{(p,\ q)}$. The averaging processing through the expression (20) is not performed on the pixel 48 having no pixel adjacent to the side on which the fourth sub-pixel $49W_{(p,\ q)}$ is positioned. For example, a pixel $48_{(p0,\ q)}$ has no pixel adjacent to the side on which a fourth sub-pixel $49W_{(p0,\ q)}$ is positioned in the X-axial direction. In this case, the averaging processing through the expression (20) is not performed on the pixel $48_{(p0,\ q)}$, and the second generated signal value $W2_{(p0,\ q)}$ is assumed to be a corrected second generated signal value $W2AV_{(p0,\ q)}$.

In the first embodiment, each of d and e is 1. However, each of d and e is not limited to 1 so long as the corrected second generated signal value $W2AV_{(p,\ q)}$ is obtained by averaging the second generated signal value $W2_{(p,\ q)}$ and the second generated signal value $W2_{(p+1,\ q)}$ with a predetermined ratio. For example, the values may be as follows: d=3, e=1; or d=5, e=3. The signal processing unit 20 uses the pixel $48_{(p+1,\ q)}$ adjacent to the side on which the fourth sub-pixel $49W_{(p,\ q)}$ is positioned in the X-axial direction as a pixel adjacent to the pixel $48_{(p,\ q)}$. Although the signal processing unit 20 preferably selects a pixel adjacent to the pixel $48_{(p,\ q)}$ along the X-axial direction as an adjacent pixel, the pixel 48 adjacent to the pixel $48_{(p,\ q)}$ in any direction may be used to calculate the corrected second generated signal value $W2AV_{(p,\ q)}$. The adjacent pixel is not limited to the pixel $48_{(p+1,\ q)}$, and may be a pixel $48_{(p-1,\ q)}$, a pixel $48_{(p,\ q+1)}$, and a pixel $48_{(p,\ q-1)}$, for example. The signal processing unit 20 may calculate the corrected second generated signal value $W2AV_{(p,\ q)}$ based on three or more adjacent pixels.

The signal processing unit 20 averages the third generated signal value $W3_{(p,\ q)}$ of the fourth sub-pixel $49W_{(p,\ q)}$ in the pixel $48_{(p,\ q)}$ and a third generated signal value $W3_{(p+1,\ q)}$ of the fourth sub-pixel $49W_{(p+1,\ q)}$ in the adjacent pixel $48_{(p+1,\ q)}$ to calculate the corrected third generated signal value $W3AV_{(p,\ q)}$ of the fourth sub-pixel $49W_{(p,\ q)}$ in the pixel $48_{(p,\ q)}$. More specifically, the signal processing unit 20 calculates the corrected third generated signal value $W3AV_{(p,\ q)}$ of the fourth sub-pixel $49W_{(p,\ q)}$ through the following expression (21). In the expression (21), f and g are predetermined coefficients.

$$W3AV_{(p,q)}=(f\cdot W3_{(p,q)}+g\cdot W3_{(p+1,q)})/(f+g) \tag{21}$$

The signal processing unit 20 uses the pixel $48_{(p+1,\ q)}$ adjacent to a side on which the fourth sub-pixel $49W_{(p,\ q)}$ is positioned in the X-axial direction as a pixel adjacent to the pixel $48_{(p,\ q)}$. The averaging processing through the expression (21) is not performed on the pixel 48 having no pixel adjacent to the side on which the fourth sub-pixel $49W_{(p,\ q)}$ is positioned. For example, a pixel $48_{(p0,\ q)}$ has no pixel adjacent to the side on which the fourth sub-pixel $49W_{(p0,\ q)}$ is positioned in the X-axial direction. In this case, the averaging processing through the expression (21) is not performed on the pixel $48_{(p0,\ q)}$, and the third generated signal value $W3_{(p0,\ q)}$ is assumed to be a corrected third generated signal value $W3AV_{(p0,\ q)}$.

In the first embodiment, each of f and g is 1. However, each of f and g is not limited to 1 so long as the corrected third generated signal value $W3AV_{(p,\ q)}$ is obtained by averaging the third generated signal value $W3_{(p,\ q)}$ and the third generated signal value $W3_{(p+1,\ q)}$ with a predetermined ratio. For example, the values may be as follows: f=3, g=1; or f=5, g=3. It is preferred that f is the same value as d, and g is the same value as e. However, f is not necessarily the same value as d, and g is not necessarily the same value as e. Each of the values may be freely taken. The signal processing unit 20 uses the pixel $48_{(p+1,\ q)}$ adjacent to the side on which the fourth sub-pixel $49W_{(p,\ q)}$ is positioned in the X-axial direction as a pixel adjacent to the pixel $48_{(p,\ q)}$. Although the signal processing unit 20 preferably selects a pixel adjacent to the pixel $48_{(p,\ q)}$ along the X-axial direction as the adjacent pixel, the pixel 48 adjacent to the pixel $48_{(p,\ q)}$ in an arbitrary direction may be used to calculate the corrected third generated signal value $W3AV_{(p,\ q)}$. The adjacent pixel is not limited to the pixel $48_{(p+1,\ q)}$, and may be a pixel $48_{(p-1,\ q)}$, a pixel $48_{(p,\ q+1)}$, and a pixel $48_{(p,\ q-1)}$, for example. The signal processing unit 20 may calculate the corrected third generated signal value $W3AV_{(p,\ q)}$ based on three or more adjacent pixels.

In this way, the signal processing unit 20 averages the generated signal value and the generated signal value of the adjacent pixel to calculate the corrected second generated signal value $W2AV_{(p,\ q)}$ and the corrected third generated signal value $W3AV_{(p,\ q)}$. Next, the following describes calculation of the output signal value $X_{4-(p,\ q)}$ for the fourth sub-pixel $49W_{(p,\ q)}$ in the pixel $48_{(p,\ q)}$.

The signal processing unit 20 calculates the output signal value $X_{4-(p,\ q)}$ for the fourth sub-pixel $49W_{(p,\ q)}$ based on the first generated signal value $W1_{(p,\ q)}$, the corrected second generated signal value $W2AV_{(p,\ q)}$, and the corrected third generated signal value $W3AV_{(p,\ q)}$. Specifically, the signal processing unit 20 calculates the output signal value $X_{4-(p,\ q)}$ for the fourth sub-pixel $49W_{(p,\ q)}$ through the following expression (22).

$$X_{4-(p,q)}=\min(W1_{(p,q)},\max(W2AV_{(p,q)},W3AV_{(p,q)})) \tag{22}$$

As represented by the expression (22), the signal processing unit 20 calculates the output signal value $X_{4-(p,\ q)}$ based on the corrected second generated signal value $W2AV_{(p,\ q)}$ and the corrected third generated signal value $W3AV_{(p,\ q)}$ obtained by averaging the generated signal value of the pixel itself and the generated signal value of the adjacent pixel. The signal processing unit 20 selects a larger value between the corrected second generated signal value $W2AV_{(p,\ q)}$ that is a calculation value for minimizing the replacement of the output signals for the first to the third sub-pixels 49R, 49G, and 49B with the output signal for the fourth sub-pixel 49W, and the corrected third generated signal value $W3AV_{(p,\ q)}$ that is a calculation value obtained based on the second generated signal value $W2_{(p,\ q)}$ for smoothing the color change in the white component. The signal processing unit 20 then takes, as the output signal value $X_{4-(p,\ q)}$, a smaller value between the larger value between the corrected second generated signal value $W2AV_{(p,\ q)}$ and the corrected third generated signal value $W3AV_{(p,\ q)}$, and the first generated signal value $W1_{(p,\ q)}$ that is a calculation value for maximizing the replacement of the output signals for the first to the third sub-pixels 49R, 49G, and 49B with the output signal for the fourth sub-pixel 49W.

As preprocessing of calculation of the output signal value $X_{4-(p,\ q)}$, the first generated signal value $W1_{(p,\ q)}$ and the corrected third generated signal value $W3AV_{(p,\ q)}$ may be averaged, or the corrected second generated signal value $W2AV_{(p,\ q)}$ and the corrected third generated signal value $W3AV_{(p,\ q)}$ may be averaged. Specifically, the signal processing unit 20 may perform the averaging processing through the following expressions (23) or (24) to calculate an averaged corrected third generated signal value $W3AV1_{(p,\ q)}$, and may calculate the output signal value $X_{4-(p,\ q)}$ through an expression (25) based on the averaged corrected third generated signal value $W3AV1_{(p,\ q)}$. In the expressions (23) and (24), h and i are predetermined coefficients.

$$W3AV1_{(p,q)}=(h\cdot W1_{(p,q)}+i\cdot W3AV_{(p,q)})/(h+i) \tag{23}$$

$$W3AV1_{(p,q)}=(h\cdot W2_{(p,q)}+i\cdot W3AV_{(p,q)})/(h+i) \tag{24}$$

$$X_{4-(p,q)}=\min(W1_{(p,q)},\max(W2AV_{(p,q)},W3AV1_{(p,q)})) \tag{25}$$

Next, the following describes a method of obtaining the signal values $X_{1-(p,\ q)}$, $X_{2-(p,\ q)}$, $X_{3-(p,\ q)}$, and $X_{4-(p,\ q)}$ that are output signals for the pixel $48_{(p,\ q)}$ (expansion processing). The following processing is performed to keep a ratio among the luminance of the first primary color displayed by (first sub-pixel 49R+fourth sub-pixel 49W), the luminance of the second primary color displayed by (second sub-pixel 49G+fourth sub-pixel 49W), and the luminance of the third primary color displayed by (third sub-pixel 49B+fourth sub-pixel 49W). The processing is performed to also keep (maintain) color tone. In addition, the processing is performed to keep (maintain) a gradation-luminance characteristic (gamma characteristic, γ characteristic). When all of the input signal values are 0 or small values in any one of the pixels 48 or a group of the pixels 48, the expansion coefficient α may be obtained without including such a pixel 48 or a group of pixels 48.

First Process

First, the signal processing unit 20 obtains the saturation S and the brightness V(S) of the pixels 48 based on the input signal values of the sub-pixels 49 of the pixels 48. Specifically, $S_{(p,\ q)}$ and $V(S)_{(p,\ q)}$ are obtained through the expressions (4) and (5) based on the signal value $x_{1-(p,\ q)}$ that is the input signal of the first sub-pixel $49R_{(p,\ q)}$, the signal value $x_{2-(p,\ q)}$ that is the input signal of the second sub-pixel $49G_{(p,\ q)}$, and the signal value $x_{3-(p,\ q)}$ that is the input signal of the third sub-pixel $49B_{(p,\ q)}$, each of those signal values being input to the (p, q)-th pixel $48_{(p,\ q)}$. The signal processing unit 20 performs this processing on all of the pixels 48.

Second Process

Next, the signal processing unit 20 obtains the expansion coefficient α(S) based on the Vmax(S)/V(S) obtained in the pixels 48.

$$\alpha(S)=V\max(S)/V(S) \tag{26}$$

Third Process

Subsequently, the signal processing unit 20 calculates the first generated signal value $W1_{(p,\ q)}$, the second generated signal value $W2_{(p,\ q)}$, the third generated signal value $W3_{(p,\ q)}$, the corrected second generated signal value $W2AV_{(p,\ q)}$, and the corrected third generated signal value $W3AV_{(p,\ q)}$. Specifically, the signal processing unit 20 calculates the first generated signal value $W1_{(p,\ q)}$, the second generated signal value $W2_{(p,\ q)}$, the third generated signal value $W3_{(p,\ q)}$, the corrected second generated signal value $W2AV_{(p,\ q)}$, and the corrected third generated signal value $W3AV_{(p,\ q)}$ through the expressions (8) to (21).

Fourth Process

Subsequently, the signal processing unit 20 obtains the output signal value $X_{4-(p,\ q)}$ for the (p, q)-th pixel $48_{(p,\ q)}$ based on a generated signal of the fourth sub-pixel $49W_{(p,\ q)}$ in the pixel $48_{(p,\ q)}$ and a generated signal of the fourth sub-pixel $49W_{(p+1,\ q)}$ in the adjacent pixel $48_{(p+1,\ q)}$. Specifically, the signal processing unit 20 calculates the output signal value $X_{4-(p,\ q)}$ for the pixel $48_{(p,\ q)}$ through the expression (22) based on the first generated signal value $W1_{(p,\ q)}$, the corrected second generated signal value $W2AV_{(p,\ q)}$, and the corrected third generated signal value $W3AV_{(p,\ q)}$.

Fifth Process

Subsequently, the signal processing unit 20 obtains the output signal value $X_{1-(p,\ q)}$ for the (p, q)-th pixel $48_{(p,\ q)}$ based on the input signal value $x_{1-(p,\ q)}$, the expansion coefficient α, and the output signal value $X_{4-(p,\ q)}$, obtains the output signal value $X_{2-(p,\ q)}$ for the (p, q)-th pixel $48_{(p,q)}$ based on the input signal value $x_{2-(p,q)}$, the expansion coefficient α, and the output signal value $X_{4-(p,\ q)}$, and obtains the output signal value $X_{3-(p,q)}$ for the (p, q)-th pixel $48_{(p,q)}$ based on the input signal value $x_{3-(p,q)}$, the expansion coefficient α, and the output signal value $X_{4-(p,\ q)}$. Specifically, the signal processing unit 20 obtains the output signal value $X_{1-(p,\ q)}$, the output signal value $X_{2-(p,\ q)}$, and the output signal value $X_{3-(p,\ q)}$ for the (p, q)-th pixel $48_{(p,\ q)}$ based on the expressions (1) to (3) described above.

The signal processing unit 20 expands the value of $Min_{(p,\ q)}$ with the expansion coefficient α as represented by the expressions (8) to (22). In this way, when the value of $Min_{(p,\ q)}$ is expanded with the expansion coefficient α, not only the luminance of the white display sub-pixel (fourth sub-pixel 49W) but also the luminance of the red display sub-pixel, the green display sub-pixel, and the blue display sub-pixel (corresponding to the first sub-pixel 49R, the second sub-pixel 49G, and the third sub-pixel 49B, respectively) is increased. Due to this, dullness of color can be prevented. That is, when the value of $Min_{(p,\ q)}$ is expanded with the expansion coefficient α, the luminance of the entire image is multiplied by α as compared with a case in which the value of $Min_{(p,\ q)}$ is not expanded. Accordingly, for example, a static image and the like can be preferably displayed with high luminance.

In the display device 10 according to the first embodiment, the output signal value $X_{1-(p,\ q)}$, the output signal value $X_{2-(p,\ q)}$, and the output signal value $X_{3-(p,\ q)}$ for the (p, q)-th pixel are expanded by α times. Accordingly, the display device 10 may reduce the luminance of the light source device 60 based on the expansion coefficient α so as to cause the luminance to be the same as that of the image that is not expanded. Specifically, the luminance of the light source device 60 may be multiplied by (1/α). Accordingly, power consumption of the light source device 60 can be reduced. The signal processing unit 20 outputs this (1/α) as the light-source-device control signal SBL to the light-source-device control unit 50 (refer to FIG. 1).

Operation of Signal Processing Unit

Figure 8:
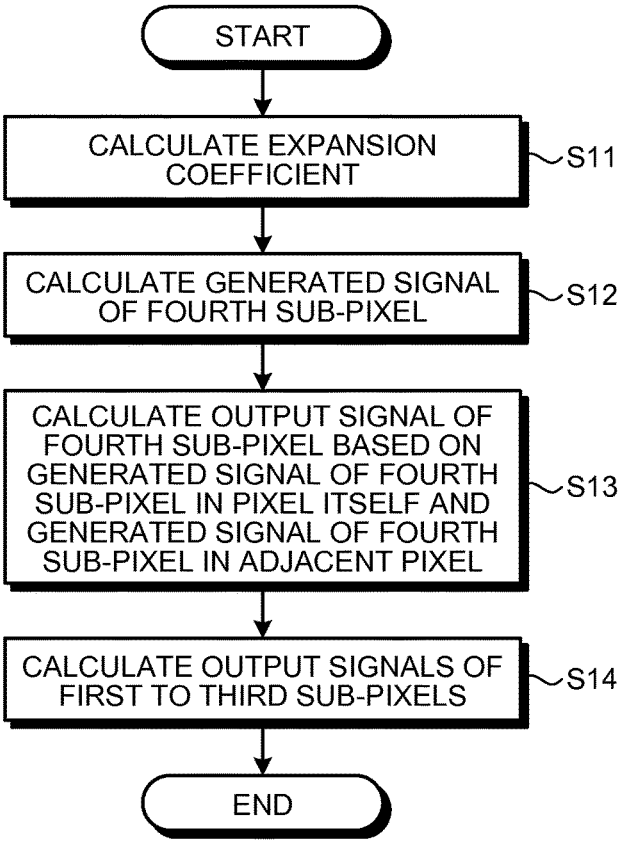
FIG. 8 is a flowchart illustrating an operation of the signal processing unit.

Next, the following describes an operation of the signal processing unit 20 in calculating an output signal with reference to a flowchart. FIG. 8 is a flowchart illustrating the operation of the signal processing unit.

The signal processing unit 20 calculates the expansion coefficient α by the α calculation unit 24 based on the input signal input to the input unit 22 (Step S11). Specifically, the signal processing unit 20 calculates the expansion coefficient α through the above expression (26) based on the stored Vmax(S) and the brightness V(S) obtained for all the pixels 48.

After calculating the expansion coefficient α, the signal processing unit 20 calculates a generated signal of the fourth sub-pixel 49W by the expansion processing unit 26 (Step S12). Specifically, the signal processing unit 20 calculates the first generated signal value $W1_{(p,\ q)}$, the second generated signal value $W2_{(p,\ q)}$, and the third generated signal value $W3_{(p,\ q)}$ through the expressions (8) to (19) described above.

After calculating the generated signal of the fourth sub-pixel 49W, the signal processing unit 20 calculates an output signal for the fourth sub-pixel 49W by the expansion processing unit 26 based on the generated signal of the fourth sub-pixel 49W and the generated signal of the fourth sub-pixel 49W in the adjacent pixel (Step S13). Specifically, the signal processing unit 20 calculates the output signal value $X_{4-(p,\ q)}$ for the fourth sub-pixel $49W_{(p,\ q)}$ in the pixel $48_{(p,\ q)}$ based on the generated signal of the fourth sub-pixel $49W_{(p,\ q)}$ and the generated signal of the fourth sub-pixel $49W_{(p+1,\ q)}$ in the adjacent pixel $48_{(p+1,\ q)}$.

More specifically, the signal processing unit 20 calculates the corrected second generated signal value $W2AV_{(p,\ q)}$ of the fourth sub-pixel $49W_{(p,\ q)}$ through the expression (20) based on the second generated signal value $W2_{(p,\ q)}$ of the fourth sub-pixel $49W_{(p,\ q)}$ and the second generated signal value $W2_{(p+1,\ q)}$ of the fourth sub-pixel $49W_{(p+1,\ q)}$ in the adjacent pixel $48_{(p+1,\ q)}$. The signal processing unit 20 also calculates the corrected third generated signal value $W3AV_{(p,\ q)}$ of the fourth sub-pixel $49W_{(p,\ q)}$ through the expression (21) based on the third generated signal value $W3_{(p,\ q)}$ of the fourth sub-pixel $49W_{(p,\ q)}$ and the third generated signal value $W3_{(p+1,\ q)}$ of the fourth sub-pixel $49W_{(p+1,\ q)}$ in the adjacent pixel $48_{(p+1,\ q)}$. The signal processing unit 20 then calculates the output signal value $X_{4-(p,\ q)}$ for the fourth sub-pixel $49W_{(p,\ q)}$ through the expression (22) based on the first generated signal value $W1_{(p,\ q)}$, the corrected second generated signal value $W2AV_{(p,\ q)}$, and the corrected third generated signal value $W3AV_{(p,\ q)}$.

After calculating the output signal for the fourth sub-pixel 49W, the signal processing unit 20 obtains output signals for the first to the third sub-pixels based on the expansion coefficient α and the output signal for the fourth sub-pixel 49W (Step S14). More specifically, the signal processing unit 20 obtains the signal value $X_{1-(p,\ q)}$, the signal value $X_{2-(p,\ q)}$, and the signal value $X_{3-(p,\ q)}$ that are output signals for the (p, q)-th pixel $48_{(p,\ q)}$ based on the expressions (1) to (3). Then the processing for calculating the output signals by the signal processing unit 20 is ended.

Display Example

Figure 9:
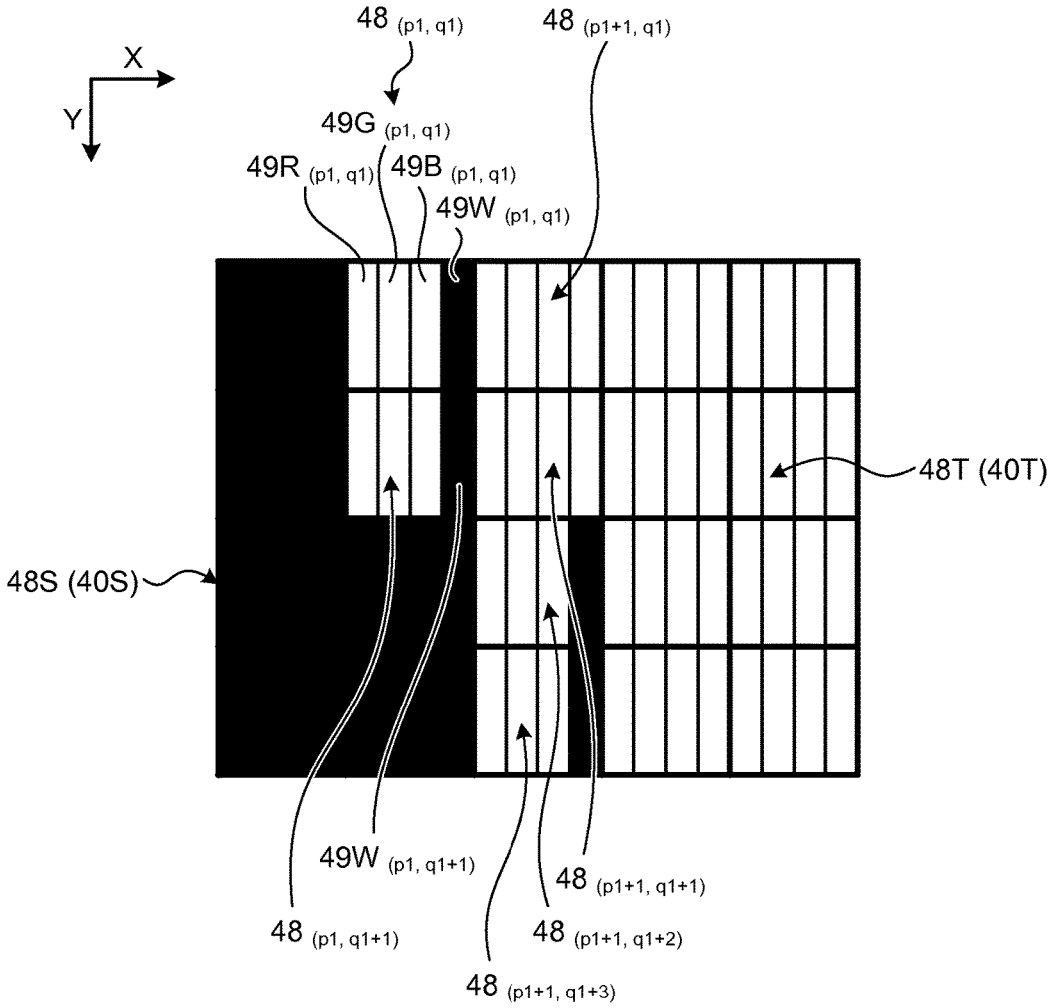
FIG.9 Related Art
FIG. 9 is a schematic diagram illustrating an example of a displayed image when expansion processing according to a comparative example is performed.
Figure 10:
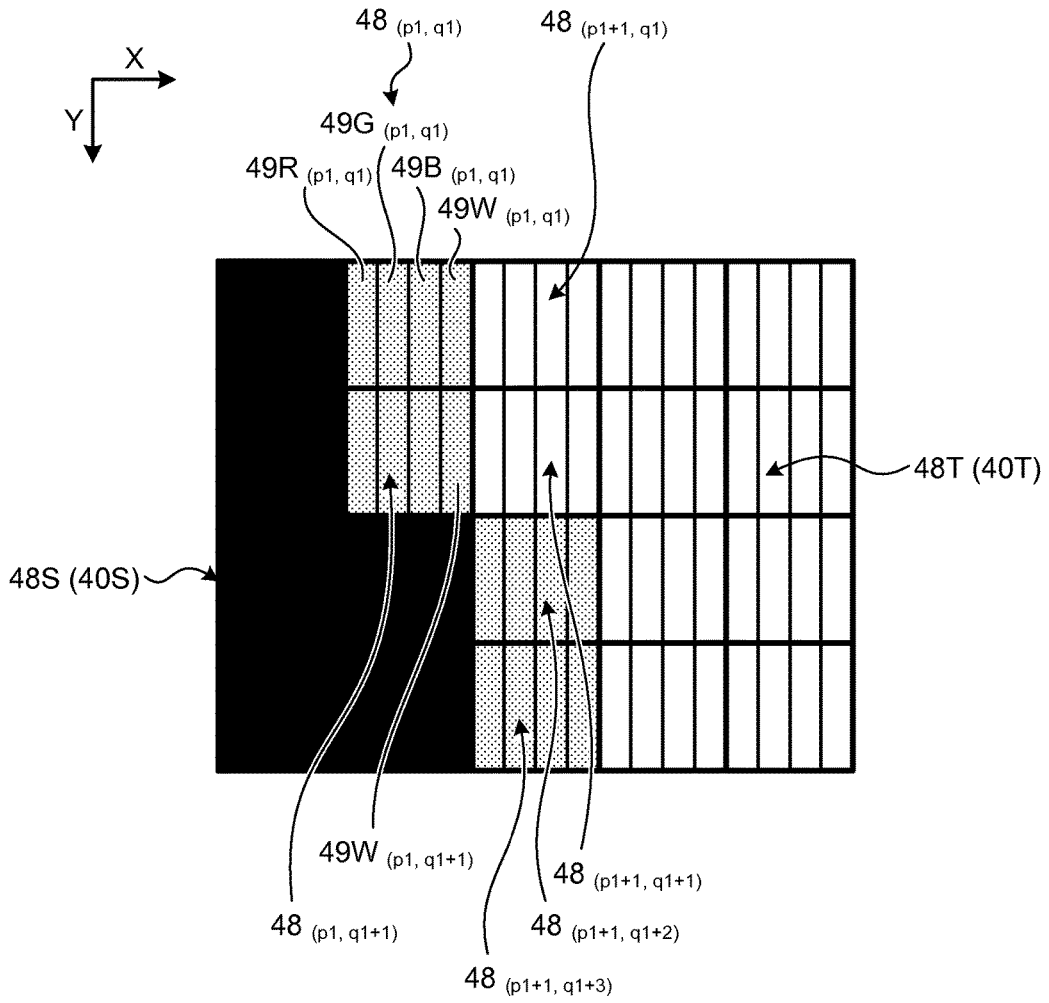
FIG. 10 is a schematic diagram illustrating an example of the displayed image when expansion processing according to the first embodiment is performed.

Next, the following describes a display example of an image in a case where the signal processing unit 20 calculates the output signal value $X_{4-(p,\ q)}$ for the fourth sub-pixel $49W_{(p,\ q)}$ based on the generated signal value of the pixel $48_{(p,\ q)}$ and the generated signal value of the adjacent pixel $48_{(p+1,\ q)}$ and performs expansion processing. FIG. 9 is a schematic diagram illustrating an example of a displayed image when expansion processing according to a comparative example is performed. FIG. 10 is a schematic diagram illustrating an example of the displayed image when expansion processing according to the first embodiment is performed. A signal processing unit according to the comparative example performs expansion processing assuming the third generated signal value $W3_{(p,\ q)}$ to be the output signal value $X_{4-(p,\ q)}$ for the fourth sub-pixel $49W_{(p,\ q)}$. That is, the signal processing unit according to the comparative example does not perform averaging processing with the adjacent pixel in calculating the output signal value $X_{4-(p,\ q)}$ for the fourth sub-pixel $49W_{(p,\ q)}$.

As illustrated in FIGS. 9 and 10, the signal processing unit according to the comparative example and the signal processing unit 20 according to the first embodiment perform expansion processing on the same image IM. In the image IM, a dark image element and a bright image element are adjacent to each other with an oblique boundary therebetween, and a pixel group 40S that displays the dark image element and a pixel group 40T that displays the bright image element are adjacent to each other. In the image IM, pixels in the pixel group 40T at the boundary between the pixel group 40T and the pixel group 40S are a pixel $\mathbf{48}_{(p1,\ q1)}$, a pixel $\mathbf{48}_{(p1,\ q1+1)}$, a pixel $\mathbf{48}_{(p1+1,\ q1+2)}$, and a pixel $\mathbf{48}_{(p1+1,\ q1+3)}$. Luminance of the pixel $\mathbf{48}_{(p1,\ q1)}$, the pixel $\mathbf{48}_{(p1,\ q1+1)}$, the pixel $\mathbf{48}_{(p1+1,\ q1+2)}$, and the pixel $\mathbf{48}_{(p1+1,\ q1+3)}$ is higher than that of a pixel 48S of the pixel group 40S, and is lower than that of the other pixels 48T of the pixel group 40T. The pixel 48S of the pixel group 40S is not lit, so that black is displayed. In the pixel 48T of the pixel group 40T, all of the first sub-pixel 49R, the second sub-pixel 49G, the third sub-pixel 49B, and the fourth sub-pixel 49W are lit.

The signal processing unit according to the comparative example calculates the output signal value $X_{4-(p,\ q)}$ for the fourth sub-pixel $\mathbf{49}W_{(p,\ q)}$ using the third generated signal value $W\mathbf{3}_{(p,\ q)}$ based on the second generated signal value $W\mathbf{2}_{(p,\ q)}$ that is the calculation value for minimizing the replacement of the output signals for the first to the third sub-pixels 49R, 49G, and 49B with an output signal for the fourth sub-pixel 49W. Accordingly, as illustrated in FIG. 9, in the pixel $\mathbf{48}_{(p1,\ q1)}$, the pixel $\mathbf{48}_{(p1,\ q1+1)}$, the pixel $\mathbf{48}_{(p1+1,\ q1+2)}$, and the pixel $\mathbf{48}_{(p1+1,\ q1+3)}$ according to the comparative example, the first sub-pixel 49R, the second sub-pixel 49G, and the third sub-pixel 49B are lit and the fourth sub-pixel 49W is not lit. That is, black is displayed by the fourth sub-pixels 49W in the pixel $\mathbf{48}_{(p1,\ q1)}$, the pixel $\mathbf{48}_{(p1,\ q1+1)}$, the pixel $\mathbf{48}_{(p1+1,\ q1+2)}$, and the pixel $\mathbf{48}_{(p1+1,\ q1+3)}$.

Black color is visible in the fourth sub-pixels 49W in the pixel $\mathbf{48}_{(p1,\ q1)}$, the pixel $\mathbf{48}_{(p1,\ q1+1)}$, the pixel $\mathbf{48}_{(p1+1,\ q1+2)}$, and the pixel $\mathbf{48}_{(p1+1,\ q1+3)}$ at the boundary because the respective sub-pixels 49 adjacent thereto in the X-axial direction are lit, so that the boundary between the fourth sub-pixel 49W and the adjacent sub-pixel 49 is likely to be visually recognized. Especially, for example, the fourth sub-pixel $\mathbf{49}W_{(p1,\ q1)}$ in the pixel $\mathbf{48}_{(p1,\ q1)}$ is adjacent to the fourth sub-pixel $\mathbf{49}W_{(p1,\ q1+1)}$ in the pixel $\mathbf{48}_{(p1,\ q1+1)}$ in the Y-axial direction. As a result, the fourth sub-pixel $\mathbf{49}W_{(p1,\ q1)}$ and the fourth sub-pixel $\mathbf{49}W_{(p1,\ q1+1)}$ are more likely to be visually recognized as a black streak along the Y-axial direction. In this way, when the signal processing unit according to the comparative example performs expansion processing on the image IM, deterioration in the image may be visually recognized.

On the other hand, the signal processing unit 20 according to the first embodiment averages the generated signal of the pixel and the generated signal of the adjacent pixel to calculate the output signal value $X_{4-(p,\ q)}$ for the fourth sub-pixel $\mathbf{49}W_{(p,\ q)}$. That is, as illustrated in FIG. 10, averaging processing is performed on the fourth sub-pixels 49W in the pixel $\mathbf{48}_{(p1,\ q1)}$, the pixel $\mathbf{48}_{(p1,\ q1+1)}$, the pixel $\mathbf{48}_{(p1+1,\ q1+2)}$, and the pixel $\mathbf{48}_{(p1+1,\ q1+3)}$ and the respective pixels 48T adjacent to the right side thereof in the X-axial direction in FIG. 10 to output the output signal value $X_{4-(p,\ q)}$. Accordingly, for the fourth sub-pixels 49W in the pixel $\mathbf{48}_{(p1,\ q1)}$, the pixel $\mathbf{48}_{(p1,\ q1+1)}$, the pixel $\mathbf{48}_{(p1+1,\ q1+2)}$, and the pixel $\mathbf{48}_{(p1+1,\ q1+3)}$, the output signal value $X_{4-(p,\ q)}$ as a value between the pixel 48S and the pixel 48T is output. That is, the fourth sub-pixels 49W in the pixel $\mathbf{48}_{(p1,\ q1)}$, the pixel $\mathbf{48}_{(p1,\ q1+1)}$, the pixel $\mathbf{48}_{(p1+1,\ q1+2)}$, and the pixel $\mathbf{48}_{(p1+1,\ q1+3)}$ are lit. Due to this, in the signal processing unit 20 according to the first embodiment, the fourth sub-pixels 49W of the pixel $\mathbf{48}_{(p1,\ q1)}$, the pixel $\mathbf{48}_{(p1,\ q1+1)}$, the pixel $\mathbf{48}_{(p1+1,\ q1+2)}$, and the pixel $\mathbf{48}_{(p1+1,\ q1+3)}$ at the boundary are not displayed in black, so that the boundary between the fourth sub-pixel 49W and the adjacent sub-pixel is prevented from being visually recognized. For example, the fourth sub-pixel $\mathbf{49}W_{(p1,\ q1)}$ in the pixel $\mathbf{48}_{(p1,\ q1)}$ and the fourth sub-pixel $\mathbf{49}W_{(p1,\ q1+1)}$ in the pixel $\mathbf{48}_{(p1,\ q1+1)}$ are lit, so that they are prevented from being visually recognized as a black streak along the Y-axial direction. In this way, when performing expansion processing on the image IM, the signal processing unit 20 according to the first embodiment can prevent deterioration in the image. The output signals for the first to the third sub-pixels in the pixel $\mathbf{48}_{(p1,\ q1)}$, the pixel $\mathbf{48}_{(p1,\ q1+1)}$, the pixel $\mathbf{48}_{(p1+1,\ q1+2)}$, and the pixel $\mathbf{48}_{(p1+1,\ q1+3)}$ are calculated based on the output signal for the fourth sub-pixel 49W after the averaging processing. Accordingly, the luminance of the pixels, that is, the pixel $\mathbf{48}_{(p1,\ q1)}$, the pixel $\mathbf{48}_{(p1,\ q1+1)}$, the pixel $\mathbf{48}_{(p1+1,\ q1+2)}$ and the pixel $\mathbf{48}_{(p1+1,\ q1+3)}$, is not changed even after the averaging processing according to the first embodiment is performed.

In this way, the display device 10 according to the first embodiment calculates the output signal value $X_{4-(p,\ q)}$ for the fourth sub-pixel based on the generated signal of the pixel itself and the generated signal of the adjacent pixel. Accordingly, the display device 10 according to the first embodiment can prevent deterioration in the image. The display device 10 according to the first embodiment calculates the output signals for the first to the third sub-pixels using the output signal value $X_{4-(p,\ q)}$ for the fourth sub-pixel thus calculated. Due to this, the display device 10 according to the first embodiment can prevent deterioration in the image without changing the luminance of the pixel.

The display device 10 according to the first embodiment calculates the output signal value $X_{4-(p,\ q)}$ for the fourth sub-pixel based on the generated signal of the pixel itself and the generated signal of the pixel adjacent to an end on the side on which the fourth sub-pixel 49W is arranged. Accordingly, the display device 10 according to the first embodiment can prevent the fourth sub-pixel 49W having low luminance sandwiched between the sub-pixels 49 having high luminance from being visually recognized. As a result, the display device 10 according to the first embodiment can more preferably prevent deterioration in the image.

The display device 10 according to the first embodiment performs averaging processing on the second generated signal value $W\mathbf{2}_{(p,\ q)}$ and the third generated signal value $W\mathbf{3}_{(p,\ q)}$ of the pixel with those of the adjacent pixel thereof. The second generated signal value $W\mathbf{2}_{(p,\ q)}$ and the third generated signal value $W\mathbf{3}_{(p,\ q)}$ are calculation values for minimizing the replacement of the output signals for the first to the third sub-pixels with the output signal value $X_{4-(p,\ q)}$ for the fourth sub-pixel. Accordingly, the display device 10 according to the first embodiment prevents the output signal value $X_{4-(p,\ q)}$ for the fourth sub-pixel from being too small (prevents the luminance of the fourth sub-pixel 49W from being too small), and can prevent deterioration in the image more preferably. The display device 10 according to the first embodiment may perform averaging processing on only one of the second generated signal value $W\mathbf{2}_{(p,\ q)}$ and the third generated signal value $W\mathbf{3}_{(p,\ q)}$. The averaging processing may also be performed on the first generated signal value $W\mathbf{1}_{(p,\ q)}$ of the pixel with that of the adjacent pixel thereof. The display device 10 according to the first embodiment may perform averaging processing on at least one of the first generated signal value $W\mathbf{1}_{(p,\ q)}$, the second generated signal value $W2_{(p, q)}$, and the third generated signal value $W3_{(p, q)}$ of the pixel with at least one of those of the adjacent pixel thereof.

The display device 10 according to the first embodiment once selects a larger value between the corrected second generated signal value $W2AV_{(p, q)}$ and the corrected third generated signal value $W3AV_{(p, q)}$ in calculating the output signal value $X_{4-(p, q)}$ for the fourth sub-pixel. Accordingly, the display device 10 prevents the output signal value $X_{4-(p, q)}$ for the fourth sub-pixel from being too small (prevents the luminance of the fourth sub-pixel 49W from being too small). The display device 10 then assumes, as the output signal value $X_{4-(p, q)}$, a smaller value between the larger value between the corrected second generated signal value $W2AV_{(p, q)}$ and the corrected third generated signal value $W3AV_{(p, q)}$, and the first generated signal value $W1_{(p, q)}$. Accordingly, the display device 10 can appropriately suppress the output signal value $X_{4-(p, q)}$ for the fourth sub-pixel, and preferably prevent deterioration in the image.

The display device 10 according to the first embodiment performs averaging processing on the second generated signal value $W2_{(p, q)}$ and the third generated signal value $W3_{(p, q)}$, and the adjacent pixels with a predetermined ratio. Accordingly, the display device 10 according to the first embodiment can appropriately calculate the output signal value $X_{4-(p, q)}$ for the fourth sub-pixel, and prevent deterioration in the image more preferably.

Figure 11:
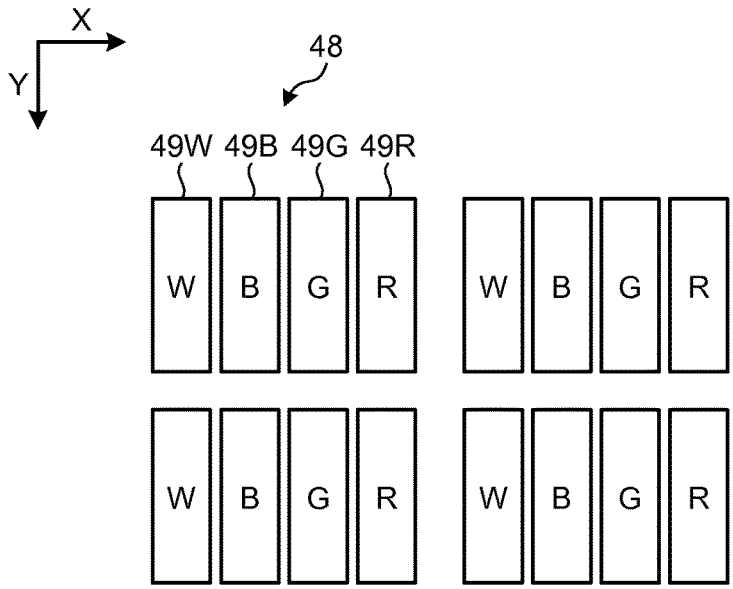
FIG. 11 is a diagram illustrating an example of the pixel array of the image display panel.
Figure 12:
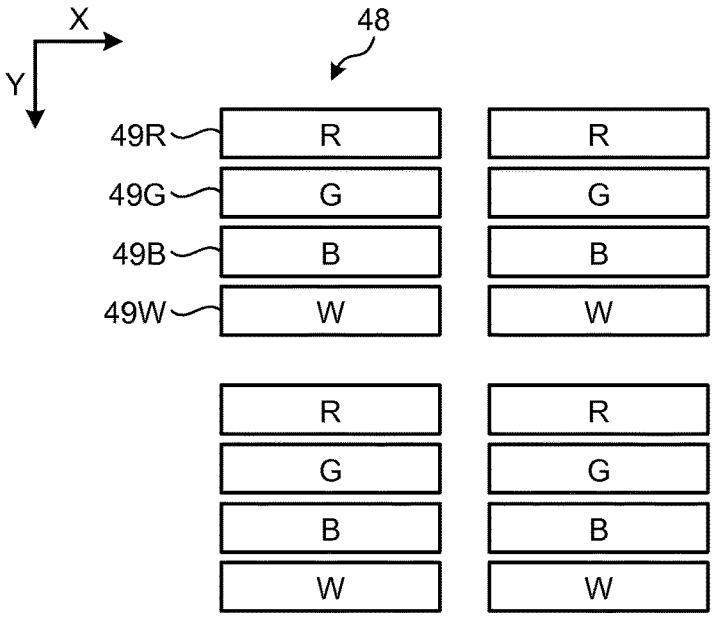
FIG. 12 is a diagram illustrating an example of the pixel array of the image display panel.
Figure 13:
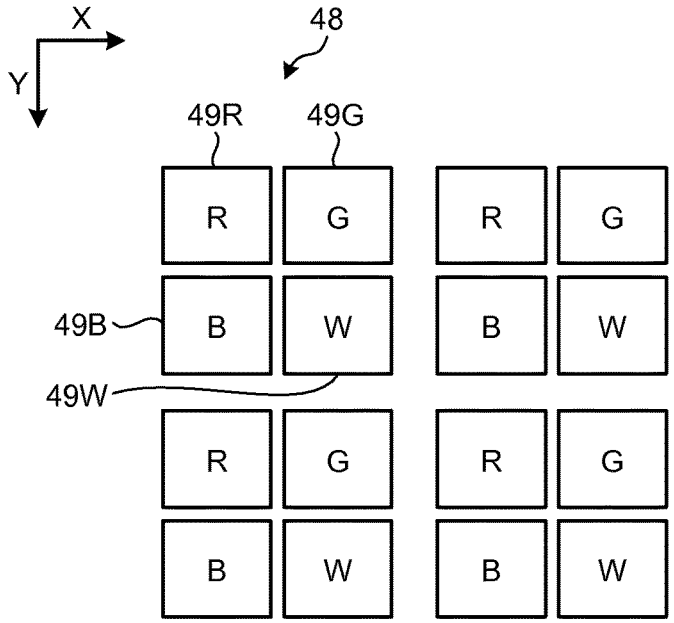
FIG. 13 is a diagram illustrating an example of the pixel array of the image display panel.

In the first embodiment, the pixel array of the image display panel 40 is not limited to the described one. It is adequate as long as the pixel array of the image display panel 40 is an array in which the pixels 48 each including the first sub-pixel 49R, the second sub-pixel 49G, the third sub-pixel 49B, and the fourth sub-pixel 49W are arranged in a two-dimensional matrix. The pixel 48 may include the first sub-pixel 49R, the second sub-pixel 49G, and either one of the third sub-pixel 49B and the fourth sub-pixel 49W. FIGS. 11 to 13 are diagrams illustrating an example of the pixel array of the image display panel. As illustrated in FIG. 11, in the pixel array of the image display panel 40, the fourth sub-pixel 49W may be arranged at an opposite end to an end at which the fourth sub-pixel 49W illustrated in FIG. 2 is arranged in the X-axial direction. As illustrated in FIG. 12, in the pixel array of the image display panel 40, the first sub-pixel 49R, the second sub-pixel 49G, the third sub-pixel 49B, and the fourth sub-pixel 49W may be arranged along the Y-axial direction. As illustrated in FIG. 13, in the pixel array of the image display panel 40, the arrangement of the first to the fourth sub-pixels in one pixel 48 may be a diagonal arrangement. In other words, the first to the fourth sub-pixels in one pixel 48 may be arranged in a square. In the example illustrated in FIG. 13, the first sub-pixel 49R and the fourth sub-pixel 49W are diagonally arranged, and the second sub-pixel 49G and the third sub-pixel 49B are diagonally arranged. In this case, the pixel 48 is formed such that the first to the fourth sub-pixels are arranged at any position among four positions, that is, two lines in the X-axial direction and two lines in the Y-axial direction. In the first embodiment, the fourth sub-pixel 49W of the pixel and the fourth sub-pixel 49W of the adjacent pixel 48, each of which include the first sub-pixel 49R, the second sub-pixel 49G, the third sub-pixel 49B, and the fourth sub-pixel 49W, are averaged. Alternatively, the fourth sub-pixels 49W of a plurality of pixels continuously adjacent to each other may be averaged.

2. Second Embodiment

Next, the following describes a second embodiment of the present invention. A display device 10*a* according to the second embodiment is different from the display device 10 according to the first embodiment in that the display device 10*a* includes an image analysis unit that analyzes an image for performing averaging processing. Except this configuration, the display device 10*a* according to the second embodiment has the same configuration as that of the display device 10 according to the first embodiment, so that description thereof will not be repeated.

Figure 14:
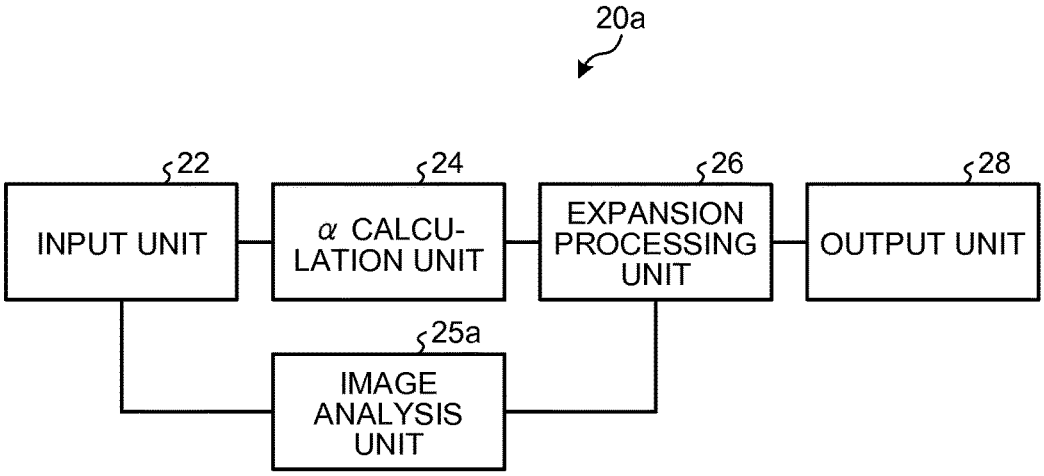
FIG. 14 is a schematic diagram illustrating an overview of a configuration of a signal processing unit according to a second embodiment.

FIG. 14 is a schematic diagram illustrating an overview of the configuration of the signal processing unit according to the second embodiment. As illustrated in FIG. 14, a signal processing unit 20*a* according to the second embodiment includes an image analysis unit 25*a*. The image analysis unit 25*a* is coupled to the input unit 22 and the expansion processing unit 26. The image analysis unit 25*a* receives input signals of all the pixels 48 input from the input unit 22. The image analysis unit 25*a* analyzes the input signals of all the pixels 48 to detect a pixel that is adjacent to the pixel $48_{(p, q)}$ and has higher luminance than that of the pixel $48_{(p, q)}$. The image analysis unit 25*a* outputs a detection result to the expansion processing unit 26. Based on the detection result of the image analysis unit 25*a*, the expansion processing unit 26 calculates the corrected second generated signal value $W2AV_{(p, q)}$ of the fourth sub-pixel $49W_{(p, q)}$ in the pixel $48_{(p, q)}$ through the expression (20) using the second generated signal value $W2_{(p, q)}$ of the fourth sub-pixel $49W_{(p, q)}$ in the pixel $48_{(p, q)}$ and the second generated signal value of the pixel adjacent thereto having higher luminance than that of the pixel $48_{(p, q)}$. Similarly, based on the detection result of the image analysis unit 25*a*, the expansion processing unit 26 calculates the corrected third generated signal value $W3AV_{(p, q)}$ of the fourth sub-pixel $49W_{(p, q)}$ in the pixel $48_{(p, q)}$ through the expression (21) using the third generated signal value $W3_{(p, q)}$ of the fourth sub-pixel $49W_{(p, q)}$ in the pixel $48_{(p, q)}$ and the third generated signal value of the pixel adjacent thereto and having higher luminance than that of the pixel $48_{(p, q)}$. The expansion processing unit 26 may change the coefficients d, e, f, and g in the expressions (20) and (21) depending on a luminance difference between the pixel $48_{(p, q)}$ and the adjacent pixel. That is, the expansion processing unit 26 may change a ratio of averaging processing depending on the luminance difference between the pixel $48_{(p, q)}$ and the adjacent pixel.

In this way, the signal processing unit 20*a* according to the second embodiment detects the adjacent pixel having higher luminance than the pixel itself by the image analysis unit 25*a*. The signal processing unit 20*a* performs averaging processing on the pixel and the adjacent pixel having higher luminance than the pixel itself to calculate the output signal for the fourth sub-pixel 49W. Accordingly, the display device 10*a* according to the second embodiment can prevent the fourth sub-pixel 49W having low luminance sandwiched between the sub-pixels each having high luminance from being visually recognized, and can prevent deterioration in the image more preferably.

3. Application Example

The display devices 10 and 10*a* can be applied to electronic apparatuses in various fields such as portable electronic apparatuses (for example, a cellular telephone and a smartphone), television apparatuses, digital cameras, notebook-type personal computers, video cameras, or meters mounted in a vehicle. In other words, the display devices 10 and 10*a* can be applied to electronic apparatuses in various fields that display a video signal input from the outside or a video signal generated inside as an image or video. Each of such electronic apparatuses includes a control device that supplies an input signal to the display devices 10 and 10*a* to control the operation of the display devices 10 and 10*a*.

The embodiments according to the present invention have been described above. However, the embodiments are not limited to content thereof. The components described above include a component that is easily conceivable by those skilled in the art, substantially the same component, and what is called an equivalent. The components described above can also be appropriately combined with each other. In addition, the components can be variously omitted, replaced, or modified without departing from the gist of the embodiment and the like described above. For example, the display devices 10 and 10*a* may include a self-luminous image display panel in which a self-luminous body such as an organic light emitting diode (OLED) is lit.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A display device comprising:

an image display panel in which pixels each including a first sub-pixel that displays a first color, a second sub-pixel that displays a second color, a third sub-pixel that displays a third color, and a fourth sub-pixel that displays a fourth color with higher luminance than that of the first sub-pixel, the second sub-pixel, and the third sub-pixel are arranged in a two-dimensional matrix; and a signal processing unit that converts an input value of an input signal into an extended value in a color space extended with the first color, the second color, the third color, and the fourth color to generate an output signal and outputs the generated output signal to the image display panel, wherein the signal processing unit determines an expansion coefficient related to the image display panel, obtains a generated signal of the fourth sub-pixel in each pixel based on an input signal of the first sub-pixel in the pixel itself, an input signal of the second sub-pixel in the pixel itself, and an input signal of the third sub-pixel in the pixel itself, and the expansion coefficient, obtains an output signal for the fourth sub-pixel in each pixel based on the generated signal of the fourth sub-pixel in the pixel itself and a generated signal of the fourth sub-pixel in a pixel adjacent thereto to be output to the fourth sub-pixel, obtains an output signal for the first sub-pixel in each pixel based on at least an input signal of the first sub-pixel, the expansion coefficient, and the output signal for the fourth sub-pixel to be output to the first sub-pixel, obtains an output signal for the second sub-pixel in each pixel based on at least the input signal of the second sub-pixel, the expansion coefficient, and the output signal for the fourth sub-pixel to be output to the second sub-pixel, and obtains an output signal for the third sub-pixel in each pixel based on at least the input signal of the third sub-pixel, the expansion coefficient, and the output signal for the fourth sub-pixel to be output to the third sub-pixel, wherein, each of the pixels is formed such that the first sub-pixel, the second sub-pixel, the third sub-pixel, and the fourth sub-pixel are arranged in a first direction, and the fourth sub-pixel is arranged at an end in the first direction of the pixel, in the image display panel, the first sub-pixel, the second sub-pixel, the third sub-pixel, and the fourth sub-pixel are linearly arranged in a second direction to form a stripe array, and the signal processing unit obtains an output signal for the fourth sub-pixel in each pixel based on the generated signal of the fourth sub-pixel in the pixel itself and the generated signal of the fourth sub-pixel in a pixel adjacent thereto in the first direction, and outputs the output signal to the fourth sub-pixel.

2. The display device according to claim 1, wherein the signal processing unit obtains the output signal for the fourth sub-pixel in each pixel based on the generated signal of the fourth sub-pixel in the pixel itself and the generated signal of the fourth sub-pixel in a pixel adjacent to an end side at which the fourth sub-pixel is arranged, and outputs the output signal to the fourth sub-pixel.

3. The display device according to claim 1, wherein each of the pixels is formed such that the first sub-pixel, the second sub-pixel, the third sub-pixel, and the fourth sub-pixel are diagonally arranged in a first direction and a second direction.

4. The display device according to claim 1, wherein the signal processing unit obtains an output signal for the fourth sub-pixel in each pixel based on the generated signal of the fourth sub-pixel in the pixel itself and a generated signal of the fourth sub-pixel in an adjacent pixel having higher luminance than that of the generated signal of the fourth sub-pixel in the pixel itself, and outputs the output signal to the fourth sub-pixel.

5. The display device according to claim 1, wherein the signal processing unit obtains an output signal for the fourth sub-pixel in each pixel by averaging the generated signal of the fourth sub-pixel in the pixel itself and the generated signal of the fourth sub-pixel in an adjacent pixel with a predetermined ratio, and outputs the output signal to the fourth sub-pixel.

6. The display device according to claim 1, wherein the fourth color is white.

7. An electronic apparatus comprising:

the display device according to claim 1; and a control device that supplies the input signal to the display device.

8. A method of driving a display device, the display device comprising an image display panel in which pixels each including a first sub-pixel that displays a first color, a second sub-pixel that displays a second color, a third sub-pixel that displays a third color, and a fourth sub-pixel that displays a fourth color with higher luminance than that of the first sub-pixel, the second sub-pixel, and the third sub-pixel are arranged in a two-dimensional matrix, the method comprising:

obtaining an output signal for each of the first sub-pixel, the second sub-pixel, the third sub-pixel, and the fourth sub-pixel; and controlling an operation of each of the first sub-pixel, the second sub-pixel, the third sub-pixel, and the fourth sub-pixel based on the output signal, wherein the obtaining of the output signal includes:

determining an expansion coefficient related to the image display panel, obtaining a generated signal of the fourth sub-pixel in each pixel based on an input signal of the first sub-pixel in the pixel itself, an input signal of the second sub-pixel in the pixel itself, and an input signal of the third sub-pixel in the pixel itself, and the expansion coefficient, obtaining an output signal for the fourth sub-pixel in each pixel based on the generated signal of the fourth sub-pixel in the pixel itself and a generated signal of the fourth sub-pixel in a pixel adjacent thereto to be output to the fourth sub-pixel, obtaining an output signal for the first sub-pixel in each pixel based on at least an input signal of the first sub-pixel, the expansion coefficient, and the output signal for the fourth sub-pixel to be output to the first sub-pixel, obtaining an output signal for the second sub-pixel in each pixel based on at least the input signal of the second sub-pixel, the expansion coefficient, and the output signal for the fourth sub-pixel to be output to the second sub-pixel, and obtaining an output signal for the third sub-pixel in each pixel based on at least the input signal of the third sub-pixel, the expansion coefficient, and the output signal for the fourth sub-pixel to be output to the third sub-pixel, wherein, each of the pixels is formed such that the first sub-pixel, the second sub-pixel, the third sub-pixel, and the fourth sub-pixel are arranged in a first direction, and the fourth sub-pixel is arranged at an end in the first direction of the pixel, in the image display panel, the first sub-pixel, the second sub-pixel, the third sub-pixel, and the fourth sub-pixel are linearly arranged in a second direction to form a stripe array, and the signal processing unit obtains an output signal for the fourth sub-pixel in each pixel based on the generated signal of the fourth sub-pixel in the pixel itself and the generated signal of the fourth sub-pixel in a pixel adjacent thereto in the first direction, and outputs the output signal to the fourth sub-pixel.

* * * * *